US009156249B1

(12) United States Patent
Sato et al.

(10) Patent No.: US 9,156,249 B1
(45) Date of Patent: Oct. 13, 2015

(54) RECORDING APPARATUS

(71) Applicant: Seiko Epson Corporation, Tokyo (JP)

(72) Inventors: Akito Sato, Matsumoto (JP); Naoki Sudo, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/676,012

(22) Filed: Apr. 1, 2015

(30) Foreign Application Priority Data

Apr. 2, 2014 (JP) ..... 2014-075996

(51) Int. Cl.
*B41J 2/21* (2006.01)
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 29/393; B41J 2/2132; B41J 2/2139
USPC ..... 347/9–12, 14, 20, 37, 40, 54, 78, 79
See application file for complete search history.

(56) References Cited

U.S. PATENT DOCUMENTS 6,886,911 B2 * 5/2005 Lee ..... 347/41
7,422,305 B2 * 9/2008 Wada ..... 347/19

FOREIGN PATENT DOCUMENTS

JP 2006-168104 A 6/2006

* cited by examiner

*Primary Examiner* — Thinh Nguyen
(74) *Attorney, Agent, or Firm* — Harness, Dickey & Pierce, P.L.C.

(57) ABSTRACT

A recording apparatus includes a plurality of complementing units which form a complementing dot for complementing a dot to be formed using a defective nozzle; and a selection unit which selects any complementing unit from among the plurality of complementing units, in which the plurality of complementing units includes a substitute nozzle complementing unit which forms the complementing dot on the first raster using a substitute nozzle, without using a vicinity formation nozzle; and a combination complementing unit which forms a complementing dot on the first raster using the substitute nozzle, and on the second raster using the vicinity formation nozzle.

7 Claims, 18 Drawing Sheets

RECORDING APPARATUS

CROSS-REFERENCE TO RELATED APPLICATIONS

This application claims priority to Japanese Patent Application No. 2014-075996 filed on Apr. 2, 2014. The entire disclosure of Japanese Patent Application No. 2014-075996 is hereby incorporated herein by reference.

BACKGROUND

1. Technical Field

The present invention relates to a recording apparatus.

2. Related Art

An ink jet printer forms dots on a matter for printing by ejecting ink droplets (liquid droplets) from nozzles according to recording data which denotes a presence or absence of a dot in each pixel, by relatively moving a plurality of nozzles which are aligned in a predetermined nozzle aligning direction and the matter for printing (matter for recording) in a relative movement direction which intersects the nozzle aligning direction. As the ink jet printer, there is a serial printer, a line printer, or the like.

In the serial printer, for example, ink droplets are ejected from a nozzle while causing a recording head to scan a matter for printing in the main scanning direction, the matter for printing is transported toward a transport direction which intersects the main scanning direction between main scanning operations, and an image using dots is printed on the matter for printing. In the serial printer, there is a printer which performs overlapping printing in which dots of a raster facing the main scanning direction are formed using a plurality of scanning operations. In the overlapping printing, partial overlapping printing in which a single region in which dots of a raster are formed in one main scanning operation, and an overlapping region in which dots of a raster are formed using a plurality of times of main scanning operation are printed is included.

In the line printer, for example, an image using dots is printed on a matter for printing by transporting the matter for printing without moving nozzles which are arranged approximately over the entire region in the width direction which intersects a transport direction of the matter for printing. Since nozzles are arranged approximately over the entire region in the width direction of the matter for printing, there is a line printer in which a plurality of recording heads with nozzle columns are used, and nozzles are overlapped with each other at a junction of neighboring two recording heads. When nozzles are partially overlapped, a single region in which dots of a raster is formed using one nozzle, and an overlapping region in which dots of a raster is formed using a plurality of nozzles are generated.

When ink droplets are not ejected from a nozzle due to clogging, or the like, or ejected ink droplets do not draw an exact track, a region of "dot omission" which is formed when a pixel in which a dot is not formed connected in a relative movement direction is formed, and a stripe such as a white stripe occurs in a printed image. In JP-A-2006-168104, an ink jet printer which includes a discharge-defective nozzle complementing unit, and a discharge-defective nozzle mitigation unit is disclosed. In the ink jet printer, a carriage on which a recording head including a plurality of nozzles is mounted performs scanning along a guide rail, a matter for recording is appropriately transported in a direction which is orthogonal to the guide rail, and an image is recorded on the matter for recording using multipass recording. When performing the multipass recording, recording is performed without transporting the matter for recording, exceptionally, with respect to a tip end portion and a rear end portion of the matter for recording. Here, in a normal printing in which recording is performed in a state in which transporting is performed, recording is performed using the discharge-defective nozzle complementing unit in which a control is performed so that data to be recorded using a discharge-defective nozzle is recorded using another nozzle which records data in another pass, and is on the same line. When performing an exceptional recording in which recording is performed in a state of no transporting, recording is performed using the discharge-defective nozzle mitigation unit in which data to be recorded using a discharge-defective nozzle is controlled so as to be recorded using a neighboring nozzle of the discharge-defective nozzle.

That is, in the technology which is disclosed in JP-A-2006-168104, when performing normal recording in which a matter for recording is transported, a complementing dot which complements a dot to be formed using a discharge-defective nozzle is usually formed in the same raster using a substitute nozzle in another pass.

In a serial printer which performs overlapping printing, when a matter for recording is transported, it is possible to form a complementing dot using a substitute nozzle in another pass with respect to a raster in which a dot is to be formed using a defective nozzle. However, there is a case in which a stripe (banding) which goes along the relative movement direction remains due to an error which occurs when the matter for recording is transported. Such a problem also exists in the technology which is disclosed in JP-A-2006-168104 in which a complementing dot is usually formed on the same raster, using a substitute nozzle in another pass at a normal time in which a matter for recording is transported. In particular, in a case in which a printer performs partial overlapping printing, when a nozzle which forms a dot at an end portion of an overlapping region which occurs in a printed image is a defective nozzle, the above described stripe is easily viewed.

In addition, in the line printer, it is possible to form a complementing dot in a raster in which a dot is to be formed using a defective nozzle, using a substitute nozzle in another recording head. However, there is a case in which a stripe which goes along the relative movement direction remains due to an error of a positional relationship between neighboring recording heads, or the like. In particular, when a nozzle which forms a dot at an end portion of an overlapping region which occurs in a printed image is a defective nozzle, the above described stripe is easily viewed.

In addition, the above described problem also exists in various recording apparatuses.

SUMMARY

An advantage of some aspects of the invention is to provide a recording apparatus in which an effect of complementing a dot to be formed using a defective nozzle which forms defective dots can be improved.

According to an aspect of the invention, there is provided a recording apparatus in which a plurality of nozzles aligned in a predetermined aligning direction and a matter for recording relatively move in a relative movement direction which is different from the aligning direction, and overlapping recording in which dots of a raster facing the relative movement direction are formed using a plurality of scanning operations is performed, and in which the plurality of nozzles include a defective nozzle which forms a defective dot, a substitute nozzle which forms a dot using another scanning operation on a first raster which is to be recorded using the defective nozzle, and a vicinity formation nozzle which forms a dot on a second raster neighboring the first raster, the recording apparatus includes a plurality of complementing units which form a complementing dot for complementing a dot to be formed using the defective nozzle; and a selection unit which selects any unit from among the plurality of complementing units, in which the plurality of complementing units includes a substitute nozzle complementing unit which forms the complementing dot on the first raster using the substitute nozzle without using the vicinity formation nozzle, and a combination complementing unit which forms the complementing dot on the first raster using the substitute nozzle, and on the second raster using the vicinity formation nozzle.

In the recording apparatus, the plurality of complementing units may include a vicinity complementing unit which forms the complementing dot on the second raster using the vicinity formation nozzle without using the substitute nozzle, instead of the substitute nozzle complementing unit.

According to the aspect, it is possible to provide a recording apparatus which can improve an effect of complementing a dot to be formed using a defective nozzle which forms a defective dot.

According to another aspect of the invention, there is provided a recording apparatus which includes a plurality of nozzle columns in which a plurality of nozzles are aligned in a predetermined aligning direction, nozzles of a first nozzle column and a second nozzle columns which are included in the plurality of nozzle columns are partially overlapped in the aligning direction, the plurality of nozzle columns and a matter for recording relatively move in a relative movement direction which is different from the aligning direction, and dots of a raster facing the relative movement direction are formed, and in which the plurality of nozzles include a defective nozzle which is included in the first nozzle column, and forms a defective dot, a substitute nozzle which is included in the second nozzle column, and forms a dot on a first raster which is to be recorded using the defective nozzle, and a vicinity formation nozzle which forms a dot on a second raster neighboring the first raster, the recording apparatus includes a plurality of complementing units which form a complementing dot for complementing a dot to be formed using the defective nozzle; and a selection unit which selects any complementing unit from among the plurality of complementing units based on an amount of error in positional relationship between the first nozzle column and the second nozzle column in the aligning direction, in which the plurality of complementing units includes a substitute nozzle complementing unit which forms the complementing dot on the first raster using the substitute nozzle without using the vicinity formation nozzle, and a combination complementing unit which forms the complementing dot on the first raster using the substitute nozzle, and on the second raster using the vicinity formation nozzle.

In the recording apparatus, the plurality of complementing units may include a vicinity complementing unit which forms the complementing dot on the second raster using the vicinity formation nozzle without using the substitute nozzle, instead of the substitute nozzle complementing unit.

According to the aspect, it is possible to provide a recording apparatus which can appropriately complement a dot to be formed using a defective nozzle which forms a defective dot.

The invention can be applied to a composite apparatus including a recording apparatus, a recording method including steps corresponding to the above described each unit, a processing method of a composite apparatus including the recording method, a recording program which causes a computer to execute a function corresponding to the above described each unit, a processing program of a composite apparatus including the recording program, a computer-readable medium in which these programs are recorded, and the like. The above described apparatus may be configured of a plurality of portions which are distributed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described. As a matter of course, the following embodiments are merely examples of the invention, and all of characteristics described in the embodiments are not necessarily essential in solutions of the invention.

(1) OUTLINE OF PRESENT TECHNOLOGY

First, an outline of the present technology will be described with reference to FIGS. 1 to 18.

Figure 1:
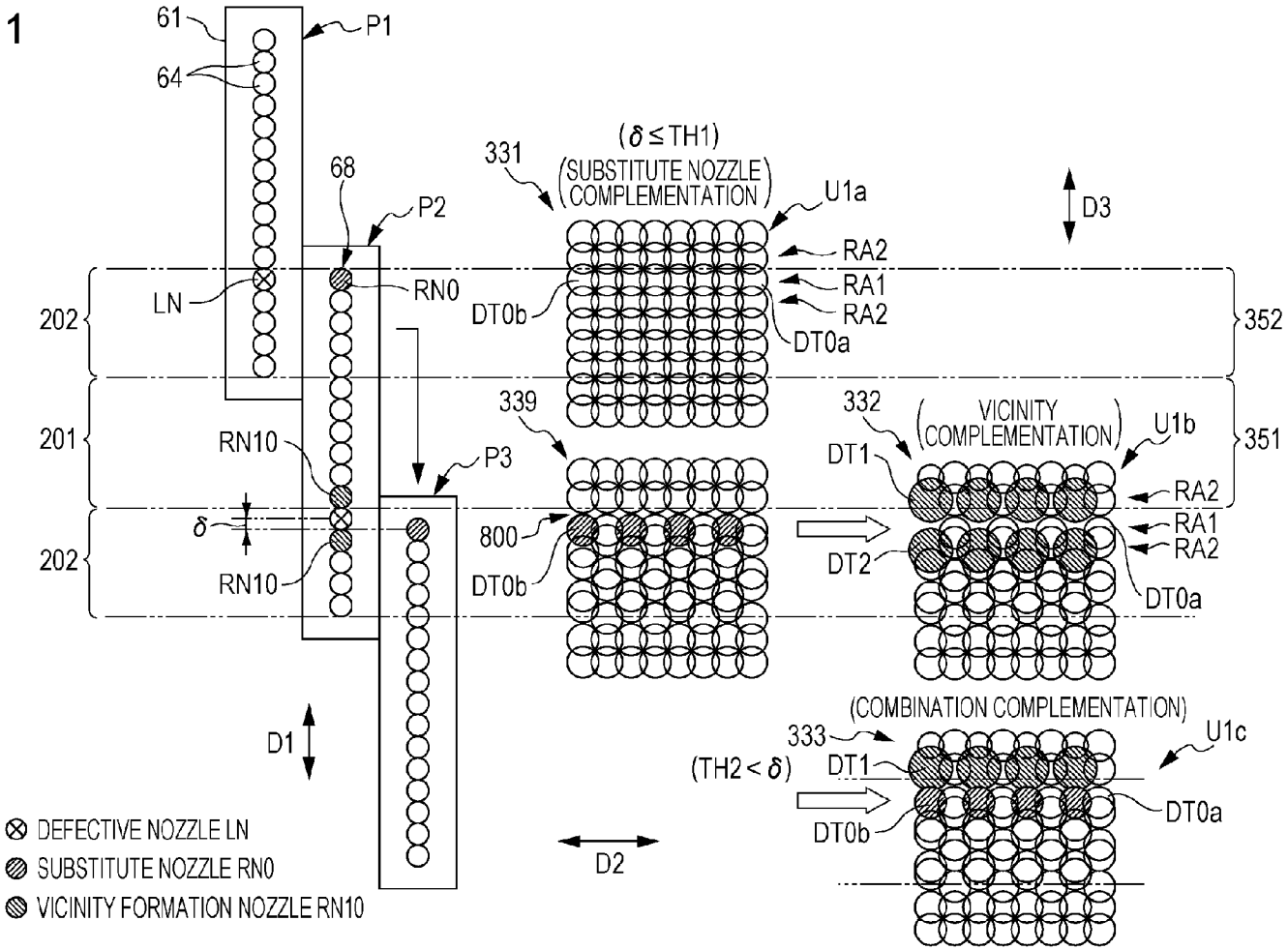
FIG. 1 is a diagram which schematically exemplifies a concept of switching a complementing process when a defective nozzle is present at an end portion of an overlapping portion in a serial printer.

In a recording apparatus 1 according to a first technology of the invention which is exemplified in FIGS. 1 to 11, a plurality of nozzles 64 which are aligned in a predetermined aligning direction D1 and a matter for recording 400 relatively move in a relative movement direction D2 which is different from the aligning direction D1, and overlapping recording in which a dot DT of a raster which faces the relative movement direction D2 is formed using a plurality of scanning operations is performed. In the plurality of nozzles 64, a defective nozzle LN which forms a defective dot, a substitute nozzle RN0 which forms a dot using another scanning operation on a first raster RA1 to be recorded using the defective nozzle LN, and a vicinity formation nozzle RN10 which forms a dot on a second raster RA2 neighboring the first raster RA1 are included. The recording apparatus 1 includes a plurality of complementing units U1 which form a complementing dot for complementing a dot to be formed using the defective nozzle LN, and a selection unit U2 which selects any complementing units U1 in the plurality of complementing units U1. The plurality of complementing units U1 include a substitute nozzle complementing unit U1*a* which forms the complementing dot on the first raster RA1 using the substitute nozzle RN0 without using the vicinity formation nozzle RN10, and a combination complementing unit U1*c* which forms the complementing dot on the second raster RA2 using the substitute nozzle RN0, and on the second raster RA2 using the vicinity formation nozzle RN10. FIG. 1 illustrates a state in which a complementing dot DT0*b* is formed on the first raster RA1, and a complementing dot DT1 is formed on the second raster RA2.

When it is possible to sufficiently complement a dot to be formed using a defective nozzle LN in dot complementation using the substitute nozzle complementing unit U1*a* in the above described process, a complementing dot (DT0*b*) is formed on the first raster RA1 using the substitute nozzle RN0, without using the vicinity formation nozzle RN10 by selecting the substitute nozzle complementing unit U1*a*. In this manner, it is possible to suppress excessive complementation in which complementation is excessively performed. In addition, when a state of insufficient complementation in which dot complementation using the substitute nozzle complementing unit U1*a* is not sufficient occurs, a complementing dot is formed on the first raster RA1 using the substitute nozzle RN0 by selecting the combination complementing unit U1*c*, and on the second raster RA2 using the vicinity formation nozzle RN10. Accordingly, according to the aspect, it is possible to provide the recording apparatus 1 which can improve an effect of complementing a dot to be formed using the defective nozzle LN which forms a defective dot.

Here, in the relative movement of plurality of nozzles and a matter for recording, a movement of the plurality of nozzles in a state in which the matter for recording does not move, a movement of the matter for recording in a state in which the plurality of nozzles do not move, and a movement of both the plurality of nozzles and the matter for recording are included. As a representative example of a recording apparatus in which a matter for recording does not move, and a plurality of nozzles move, when forming a dot by ejecting liquid droplets, there is a serial printer. As a representative example of a recording apparatus in which a plurality of nozzles do not move, and a matter for recording moves, when forming dots by ejecting liquid droplets, there is a line printer. A nozzle is a small hole which ejects liquid droplets (ink droplets). A state in which ejecting of liquid droplets is defective includes clogging which is a phenomenon in which a nozzle is blocked. In the technology, a raster means an arrangement of pixels which are continuous in a line shape toward the relative movement direction. A pixel is a minimum element configuring an image, to which a color can be allocated independently. A dot is a minimum unit of a recording result which is formed on a matter for recording using liquid droplets.

Meanwhile, the plurality of complementing units U1 may further include a vicinity complementing unit U1*b* which forms the complementing dot on the second raster RA2 using the vicinity formation nozzle RN10 without using the substitute nozzle RN0. FIG. 1 illustrates a state in which complementing dots DT1 and DT2 are formed on the second raster RA2. In this case, when it is possible to sufficiently complement a dot to be formed using the defective nozzle LN in dot complementation using the vicinity complementing unit U1*b*, a complementing dot is formed on the second raster RA2 using vicinity formation nozzle RN10 without being formed using the substitute nozzle RN0 by selecting the vicinity complementing unit U1*b*. In this manner, it is possible to suppress excessive complementation in which complementation is excessively performed, and when dot complementation using the vicinity complementing unit U1*b* can sufficiently complement a dot to be formed using the defective nozzle LN, it is possible to further appropriately suppress excessive complementation by selecting the vicinity complementing unit U1*b*. Accordingly, according to the aspect, it is possible to provide a recording apparatus 1 which can further improve an effect of complementing a dot to be formed using the defective nozzle LN.

The plurality of nozzles 64 and the matter for recording 400 may relatively move in a transport direction D3 which intersects the relative movement direction D2 between scanning operations. The selection unit U2 may select any of complementing unit U1 among the plurality of complementing units U1 based on an error amount δ which occurs during the relative movement of the matter for recording 400 toward the transport direction D3. In the aspect, a degree of complementation is changed when selecting a complementing unit U1 according to an error amount δ. When it is possible to sufficiently suppress a stripe 800 due to the above described error by complementing a dot to be formed using the defective nozzle LN, using dot complementation using the substitute nozzle complementing unit U1*a*, a complementing dot is formed on the first raster RA1 using the substitute nozzle RN0 without being formed using the vicinity formation nozzle RN10, by selecting substitute nozzle complementing unit U1*a*. In this manner, it is possible to suppress excessive complementation. In addition, when dot complementation using the substitute nozzle complementing unit U1*a* is insufficient due to the above described error, the complementing dot is formed on the first raster RA1 using the substitute nozzle RN0, and on the second raster RA2 using the vicinity formation nozzle RN10 by selecting the combination complementing unit U1*c*. Accordingly, according to the aspect, it is possible to provide a recording apparatus 1 which can further appropriately complement a dot to be formed using the defective nozzle LN.

Figure 10:
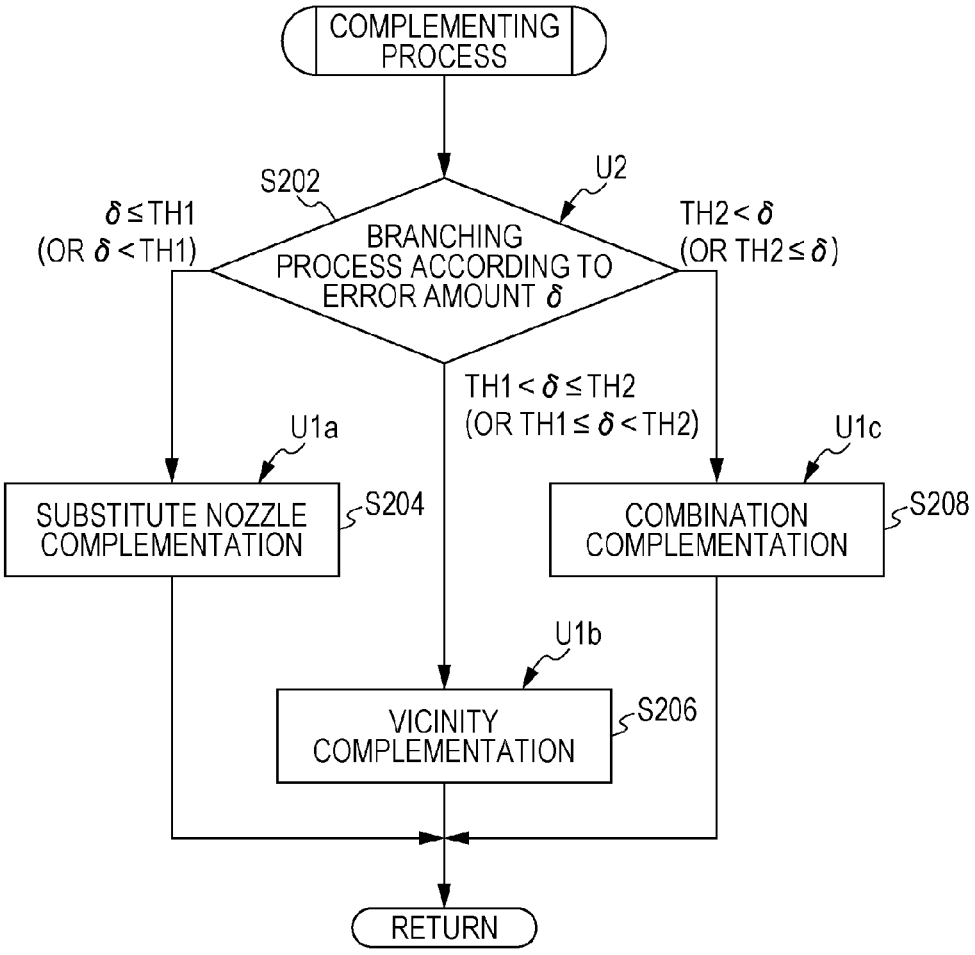
FIG. 10 is a flowchart which illustrates an example of a complementing process.
Figure 11:
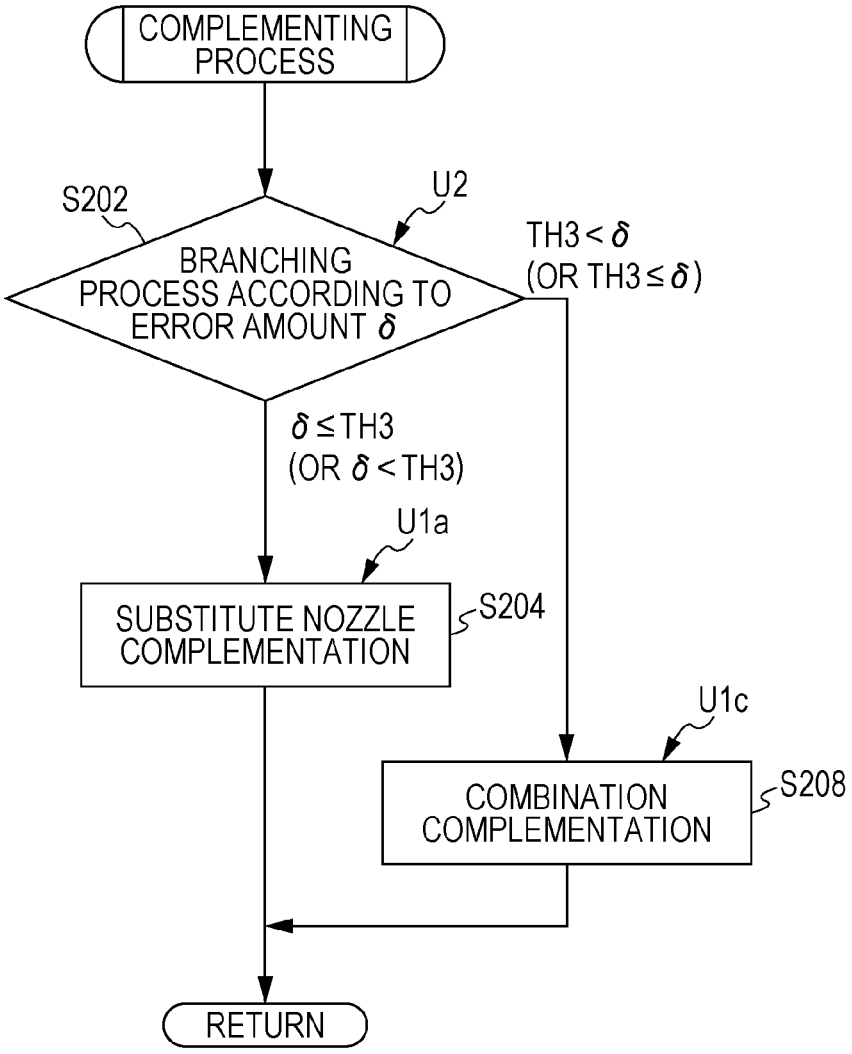
FIG. 11 is a flowchart which illustrates an example of another complementing process.

As illustrated in FIGS. 10 and 11, the selection unit U2 may select the combination complementing unit U1*c* when the error amount δ is out of a predetermined allowable range, and may select a complementing unit U1 among the plurality of complementing units U1 excluding the combination complementing unit U1*c*, when the error amount δ is in the allowable range. When the error amount δ is out of the predetermined allowable range or more, the stripe 800 which goes along the relative movement direction D2 is easily viewed. In this case, the complementing dot is formed on the first raster RA1 using the substitute nozzle RN0 by selecting the combination complementing unit U1*c*, and is also formed on the second raster RA2 using the vicinity formation nozzle RN10. When the error amount δ is in the allowable range or less, the complementing dot is formed on the first raster RA1 using the substitute nozzle RN0, or is formed on the second raster RA2 using the vicinity formation nozzle RN10, by selecting a complementing unit U1 other than the combination complementing unit U1*c*. In this manner, it is possible to suppress excessive complementation. Therefore, according to the aspect, it is possible to provide a recording apparatus 1 which can further appropriately complement a dot to be formed using the defective nozzle LN.

Figure 12:
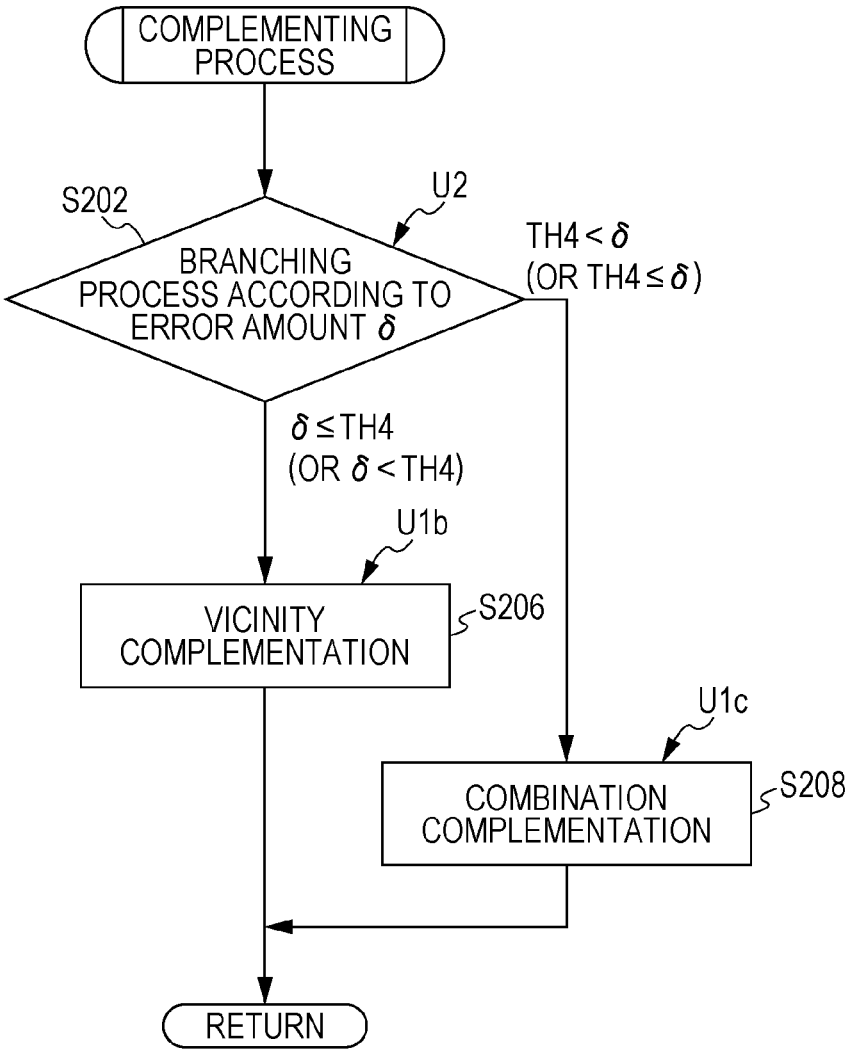
FIG. 12 is a flowchart which illustrates an example of another complementing process.

Meanwhile, a recording apparatus 1 according to a second technology which is illustrated in FIG. 12 also includes a plurality of complementing units U1, and a selection unit U2. The plurality of complementing units U1 includes a vicinity complementing unit U1*b* which forms the complementing dot on the second raster RA2 using the vicinity formation nozzle RN10 without using the substitute nozzle RN0, and a combination complementing unit U1*c* which forms the complementing dot on the second raster RA2 using the vicinity formation nozzle RN10, and on the first raster RA1 using the substitute nozzle RN0.

When it is possible to sufficiently complement a dot to be formed using the defective nozzle LN in dot complementation using the vicinity complementing unit U1*b*, as described above, a complementing dot is formed on the second raster RA2 using the vicinity formation nozzle RN10 without being formed using the substitute nozzle RN0, by selecting the vicinity complementing unit U1*b*. In this manner, it is possible to suppress excessive complementation in which complementation is excessively performed. In addition, when insufficient complementation in which dot complementation using the vicinity complementing unit U1*b* is insufficient occurs, a complementing dot is formed on the second raster RA2 using the vicinity formation nozzle RN10, and is also formed on the first raster RA1 using the substitute nozzle RN0, by selecting the combination complementing unit U1*c*. Accordingly, in the aspect, it is possible to provide a recording apparatus 1 which can improve an effect of complementing a dot to be formed using the defective nozzle LN which forms a defective dot.

The selection unit U2 may select any complementing unit U1 among the plurality of complementing units U1 based on an error amount δ which occurs due to a relative movement of the matter for recording 400 toward the transport direction D3. In addition, the selection unit U2 may select the combination complementing unit U1*c* when the error amount δ is out of a predetermined allowable range, and may select a complementing unit U1 among the plurality of complementing units U1 excluding the combination complementing unit U1*c*, when the error amount δ is in the allowable range. Also in the aspect, it is possible to obtain the above described operation and effect.

Figure 13:
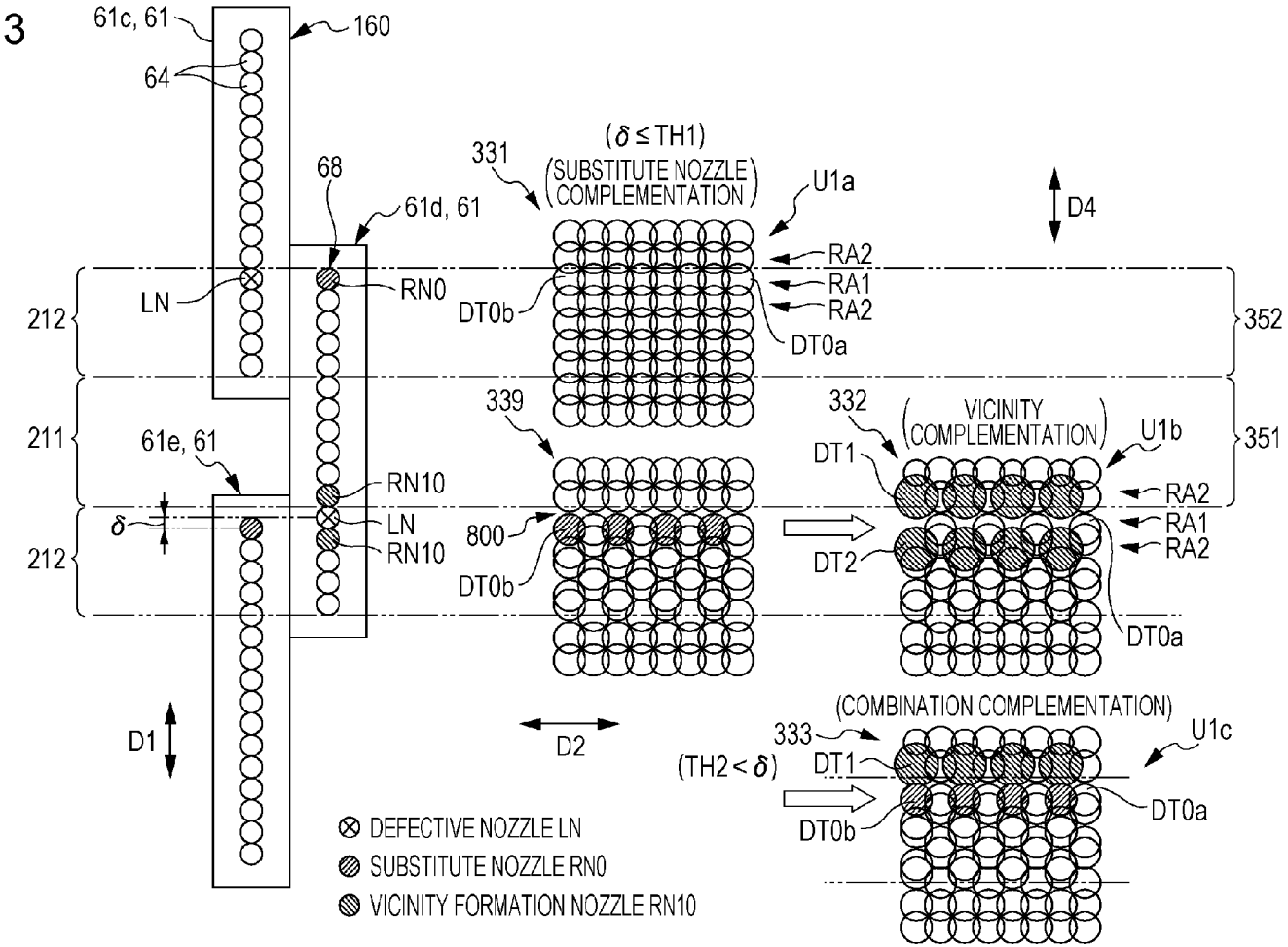
FIG. 13 is a diagram which schematically exemplifies a concept of switching a complementing process when a defective nozzle is present at an end portion of the overlapping portion in a line printer.

Meanwhile, a recording apparatus 1 according to a third embodiment includes a plurality of nozzle columns 68 in which a plurality of nozzles 64 are aligned in the aligning direction D1 which is different from the relative movement direction D2, the nozzles 64 of a first nozzle column 68*a* and a second nozzle column 68*b* (refer to FIG. 14) which are included in the plurality of nozzle columns 68 are partially overlapped with each other in the aligning direction D1, the plurality of nozzle columns 68 and a matter for recording 400 relatively move in the relative movement direction D2, and dots DT of a raster facing the relative movement direction D2 are formed. In addition, the third technology is exemplified in FIGS. 13 to 18. The relative movement of a plurality of nozzle columns and a matter for recording includes a movement of a matter for recording without a movement of the plurality of nozzle columns, a movement of the plurality of nozzle columns without a movement of the matter for recording, and movements of both the plurality of nozzle columns and the matter for recording. As a representative example of a recording apparatus in which a plurality of nozzle columns do not move, and a matter for recording moves when forming dots by ejecting liquid droplets, there is a line printer which includes a plurality of heads in which nozzle columns are partially overlapped with each other. As a representative example of a recording apparatus in which a matter for recording does not move, and a plurality of nozzle columns move, when forming dots by ejecting liquid droplets, there is a multihead-type serial printer in which a plurality of heads in which nozzle columns are partially overlapped with each other are mounted on a carriage. In the plurality of nozzles 64, a defective nozzle LN which is included in the first nozzle column 68*a*, and forms a defective dot, a substitute nozzle RN0 which is included in the second nozzle column 68*b*, and forms a dot on the first raster RA1 which is to be recorded using the defective nozzle LN, and a vicinity formation nozzle RN10 which forms a dot on the second raster RA2 neighboring the first raster RA1 are included. The recording apparatus 1 includes the plurality of complementing units U1 which form a complementing dot for complementing a dot to be formed using the defective nozzle LN, and the selection unit U2 which selects any complementing unit U1 among the plurality of complementing units U1 based on an error amount δ of a positional relationship between the first nozzle column 68*a* and the second nozzle column 68*b* in the aligning direction D1. The plurality of complementing units U1 includes the substitute nozzle complementing unit U1*a* which forms the complementing dot on the first raster RA1 using the substitute nozzle RN0 without using the vicinity formation nozzle RN10, and the combination complementing unit U1*c* which forms the complementing dot on the first raster RA1 using the substitute nozzle RN0, and on the second raster RA2 using the vicinity formation nozzle RN10. FIG. 13 illustrates a state in which a complementing dot DT0*b* is formed on the first raster RA1, and a complementing dot DT1 is formed on the second raster RA2.

As described above, a degree of dot complementation is changed by selecting the complementing unit U1 according to the error amount δ. When it is not possible to sufficiently suppress the stripe 800 due to the error by complementing the dot to be formed using the defective nozzle LN in dot complementation using the substitute nozzle complementing unit U1*a*, the complementing dot is formed on the first raster RA1 using the substitute nozzle RN0 without being formed using the vicinity formation nozzle RN10 by selecting the substitute nozzle complementing unit U1*a*. In this manner, it is possible to suppress excessive complementation. In addition, when dot complementation using the substitute nozzle complementing unit U1*a* is insufficient due to the error, the complementing dot is formed on the first raster RA1 using the substitute nozzle RN0, and is also formed on the second raster RA2 using the vicinity formation nozzle RN10 by selecting the combination complementing unit U1*c*. Therefore, according to the aspect, it is possible to provide a recording apparatus 1 which can further appropriately complement the dot to be formed using the defective nozzle LN.

Meanwhile, the plurality of complementing units U1 may further include a vicinity complementing unit U1*b* which forms the complementing dot on the second raster RA2 using the vicinity formation nozzle RN10 without using the substitute nozzle RN0. FIG. 13 illustrates a state in which complementing dots DT1 and DT2 are formed on the second raster RA2. In this case, when it is not possible to sufficiently suppress the stripe 800 due to an error by complementing the dot to be formed using the defective nozzle LN in dot complementation using the vicinity complementing unit U1*b*, the complementing dot is formed on the second raster RA2 using the vicinity formation nozzle RN10 without being formed using the substitute nozzle RN0 by selecting the vicinity complementing unit U1*b*. In this manner, excessive complementation is suppressed, and when it is not possible to sufficiently complement the dot to be formed using the defective nozzle LN in dot complementation using the vicinity complementing unit U1*b*, excessive complementation is further appropriately suppressed by selecting the vicinity complementing unit U1*b*. Therefore, according to the aspect, it is possible to provide a recording apparatus 1 which can further appropriately complement the dot to be formed using the defective nozzle LN.

The selection unit U2 may select the combination complementing unit U1*c* when the error amount δ is out of the allowable range, and may select a complementing unit U1 among the plurality of complementing units U1 excluding the combination complementing unit U1*c*, when the error amount δ is in the allowable range. According to the aspect, it is possible to obtain the same operation and effect as the above described operation and effect.

Meanwhile, the recording apparatus 1 according to a fourth technology also includes a plurality of complementing units U1 and a selection unit U2. The plurality of complementing units U1 includes a vicinity complementing unit U1*b* which forms the complementing dot on the second raster RA2 using the vicinity formation nozzle RN10 without using the substitute nozzle RN0, and a combination complementing unit U1*c* which forms the complementing dot on the second raster RA2 using the vicinity formation nozzle RN10, and on the first raster RA1 using the substitute nozzle RN0.

As described above, a degree of dot complementation is changed by selecting the complementing unit U1 according to an error amount δ. When it is possible to sufficiently suppress the stripe 800 due to the error by sufficiently complementing the dot to be formed using the defective nozzle LN using the substitute nozzle complementing unit U1*a*, a complementing dot is formed on the second raster RA2 using the vicinity formation nozzle RN10 without being formed using the substitute nozzle RN0 by selecting the vicinity complementing unit U1*b*. In this manner, it is possible to suppress excessive complementation. In addition, when dot complementation using the vicinity complementing unit U1*b* is insufficient due to the error, the complementing dot is formed on the second raster RA2 using the vicinity formation nozzle RN10 by selecting the combination complementing unit U1*c*, and is also formed on the first raster RA1 using the substitute nozzle RN0. Therefore, according to the aspect, it is possible to provide a recording apparatus 1 which can further appropriately complement the dot to be formed using the defective nozzle LN.

The selection unit U2 may select the combination complementing unit U1*c* when the error amount δ is out of the allowable range, and may select a complementing unit U1 among the plurality of complementing units U1 excluding the combination complementing unit U1*c*, when the error amount δ is in the allowable range. Also in the embodiment, it is possible to obtain the same operation and effect as the above described operation and effect.

(2) SPECIFIC EXAMPLES OF FIRST AND SECOND TECHNOLOGIES

Figure 2:
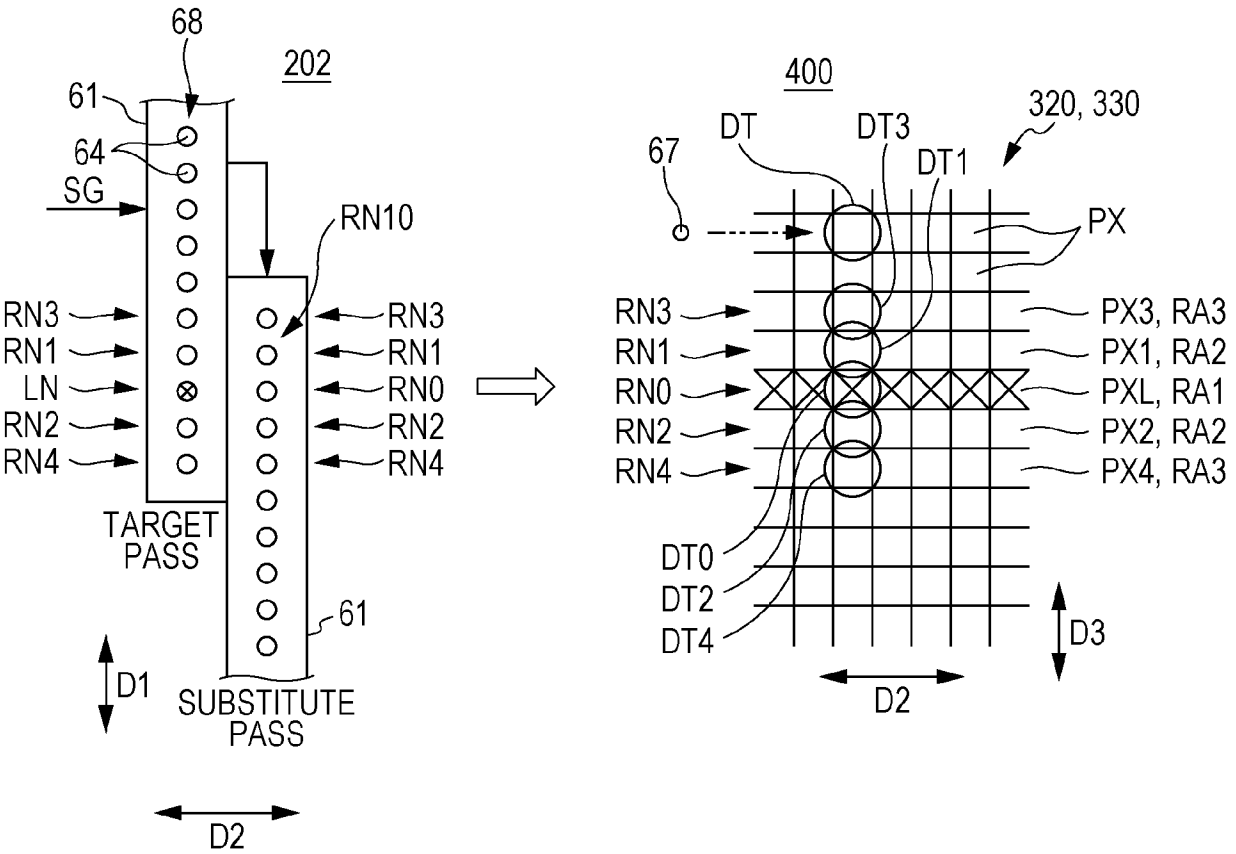
FIG. 2 is a diagram which schematically illustrates an example of a correlation between a nozzle and a pixel.
Figure 3:
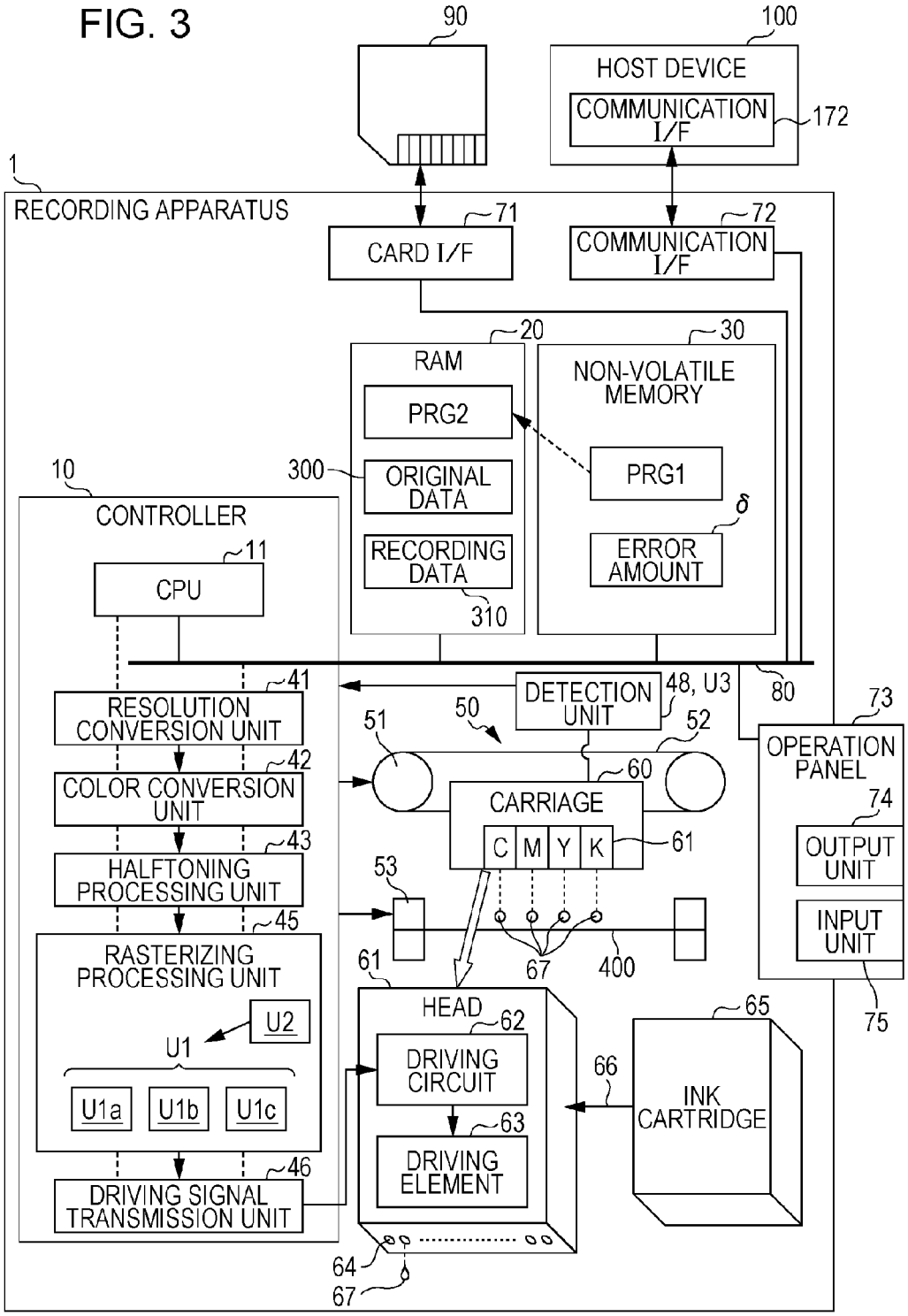
FIG. 3 is a diagram which schematically illustrates a configuration example of a serial printer as a recording apparatus.
Figure 4:
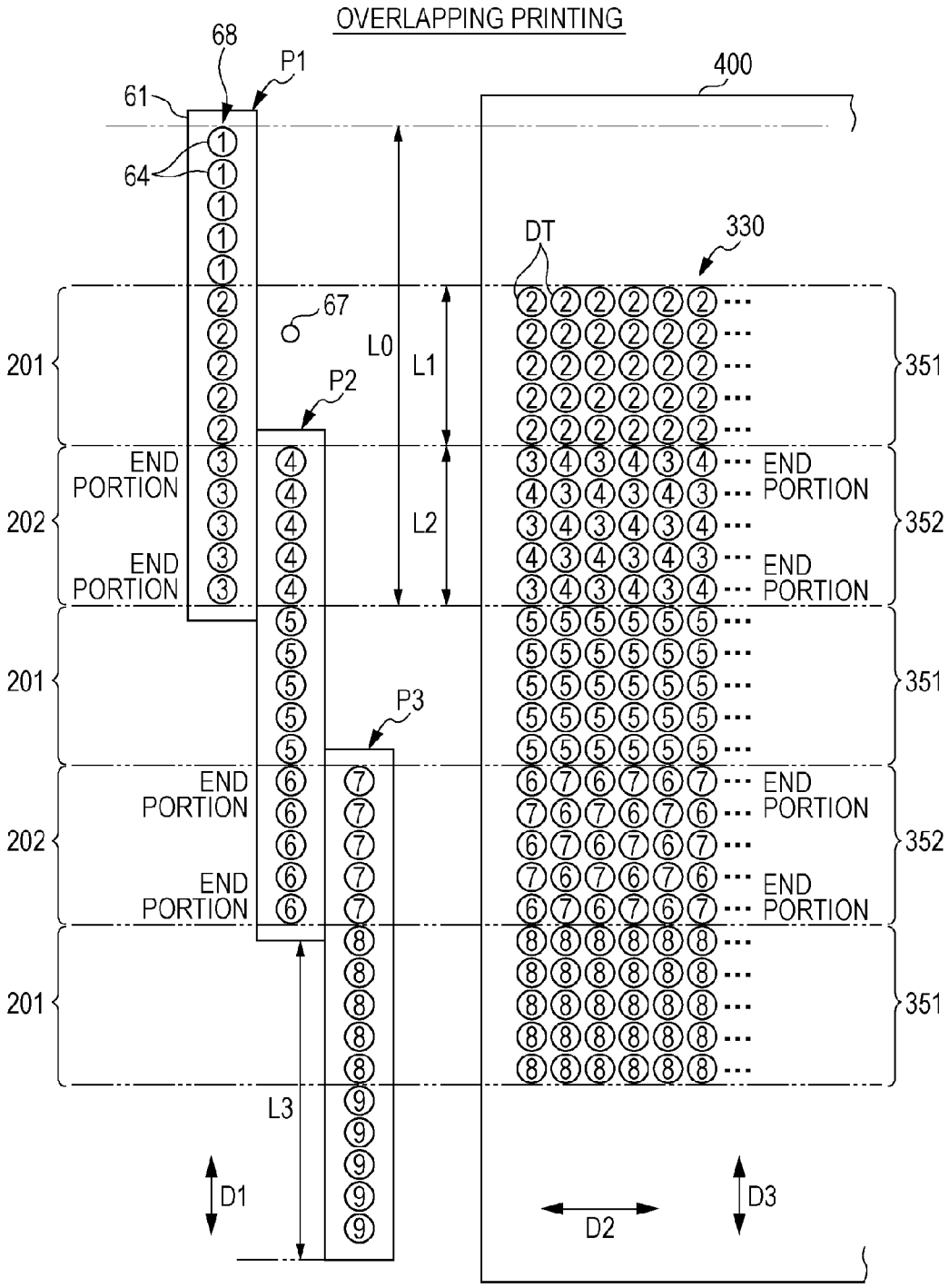
FIG. 4 is a diagram which schematically illustrates an operation example in overlapping recording.
Figure 5:
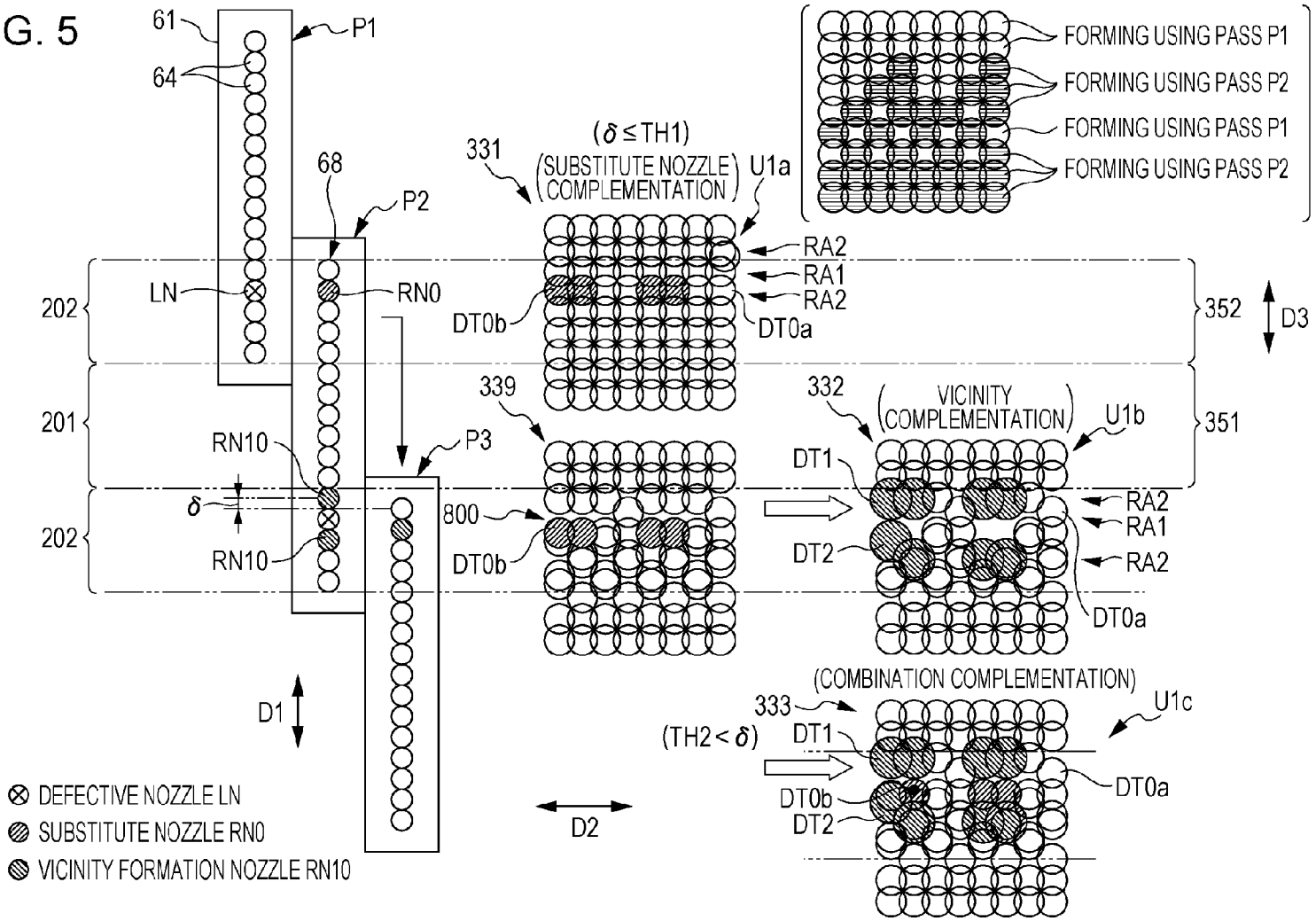
FIG. 5 is a diagram which schematically exemplifies a concept of switching a complementing process when the defective nozzle is present inside the overlapping portion.

FIGS. 1 and 5 schematically illustrate a concept of switching a complementing process when there is defective nozzle LN in the overlapping portion 202 by exemplifying a serial printer which performs partial overlapping printing (partial overlapping recording). FIG. 2 schematically illustrates an example of a correlation between a nozzle 64 and a pixel PX. FIG. 3 schematically illustrates a configuration example of a serial printer as the recording apparatus 1. FIG. 4 schematically illustrates an operation example of overlapping printing. In the specification, a reference numeral D1 denotes an aligning direction of the nozzle 64, a reference numeral D2 denotes a relative movement direction of the head 61 when ink droplets are ejected from the nozzle 64, and a reference numeral D3 denotes a transport direction of the matter for recording 400 as a matter for printing. In the specific example, the relative movement direction D2 is also referred to as a main scanning direction, and the transport direction D3 is also referred to as a sub-scanning direction. The aligning direction D1 and the transport direction D3 match with each other in the example in FIG. 1, or the like; however, the aligning direction D1 and the transport direction D3 may be shifted, for example, by approximately 45 degrees. The directions D1 and D3, and the relative movement direction D2 may be different directions, and a case in which the directions are obliquely intersecting with each other without being orthogonal, for example, appropriately at 45 degrees is also included in the invention, not only a case of being orthogonal to each other. As a matter of course, intersecting of two directions means that the two directions are shifted, including a state of being orthogonal. For ease of understanding, there is a case in which magnification of each direction is different, and each figure does not match. In addition, the dot illustrated in FIG. 1, or the like, is schematically illustrated merely for descriptions, and a size or a shape of the dot which is actually formed is not limited to those illustrated in figures. The head 61 illustrated in FIGS. 1 to 6, or the like, is schematically illustrated merely for descriptions, and an actual size, shape, or the like, is not limited to those in figures. In addition, in FIG. 2, or the like, a pitch of a pixel is set to be approximately the same in the transport direction D3 and the relative movement direction D2; however, the pitch of the pixel may be different in the transport direction D3 and the relative movement direction D2.

In addition, the matter for recording (print substrate) is a material for holding a printed image. A shape of the matter for recording is a rectangular shape in general; however, there is a circular shape (for example, optical disc such as CD-ROM and DVD), a triangular shape, a quadrangle shape, a polygonal shape, or the like, and includes at least all of types of paper and cardboard, and processed products which are described in the Japanese Industrial Standards (JIS) P0001:1998 (terms of paper, cardboard, and pulp). A resin sheet, a metallic plate, a three-dimensional object, or the like, is also included in the matter for recording.

The recording apparatus 1 generates recording data 310 which denotes a printed image 330 in which a dot to be formed using the defective nozzle LN is complemented based on the original data 300 which denotes a virtual image 320 before being subjected to dot complementation which is not actually formed. The image before complementing 320, or the image after complementing 330 is a multi-valued image or a binary image which denotes a formation situation (including presence or absence) of a dot DT with respect to respective pixels PX which are lined in order in the relative movement direction D2 and the transport direction D3, respectively. The printed image 330 is an image actually formed with respect to the matter for recording 400.

First, operations of a serial printer which performs partial overlapping printing will be described with reference to FIG. 4. As illustrated in FIG. 4, when setting a length of the nozzle column 68 in the aligning direction D1 to L0, and a transport distance of one time of the matter for recording 400 which is intermittently transported in the transport direction D3 which intersects the relative movement direction D2 is L3, L3<L0 is obtained in the overlapping printing, and (L0/2)<L3<L0 is obtained in partial overlapping printing. In the example illustrated in FIG. 4, when a dot DT using ink droplets (liquid droplets) 67 is formed due to a movement of the head 61 in the relative movement direction D2 in a pass P1 at a time in which transporting of the matter for recording 400 is stopped, the matter for recording 400 is transported by the distance L3, and a dot DT using the ink droplets 67 is formed due to a movement of the head 61 in the relative movement direction D2 in the subsequent pass P2 at a time in which transporting of the matter for recording 400 is stopped. Here, one scanning operation is referred to as a "pass". In bidirectional (Bi-d) printing, movement directions of the head 61 when ink droplets are ejected in the passes P1 and P2 are different from each other, and in unidirectional (Uni-d) printing, the movement directions of the head 61 when ink droplets are ejected in the passes P1 and P2 are the same. In the following pass P3, or the like, the same operations are also performed.

According to the above described operations, in nozzles 64 in neighboring passes, there is an overlapping portion 202 (described as OL portion in figure) of which positions in the aligning direction D1 are overlapped with each other, and a single portion 201 of which a position in the aligning direction D1 is not overlapped. In the image 330 which is formed in the matter for recording 400, an overlapping region 352 (described as OL region in figure) in which a dot DT is formed in two scanning operations, and a single region 351 in which a dot DT is formed in one scanning operation are generated. Here, nozzles of the overlapping portion 202 in the pass P1 are denoted by circled 1 and circled 3, nozzles of the single portion 201 of the pass P1 are denoted by circled 2, nozzles of the overlapping portion 202 of the pass P2 are denoted by circled 4 and circled 6, nozzles of the single portion 201 of a pass P2 are denoted by circled 5, nozzles of the overlapping portion 202 of the pass P3 are denoted by circled 7 and circled 9, nozzles of the single portion 201 of the pass P3 are denoted by circled 8, and dots corresponding to nozzles of each circled number are denoted by the same circled number. For example, in the single region 351 of the pass P1, dots are formed using nozzles of circled 2. In the overlapping region 352 of the passes P1 and P2, dots are formed using nozzles of circled 3 and circled 4. In addition, the circled numbers at an end portion of the overlapping portion 202 and the overlapping region 352 are denoted using bold strokes.

In addition, when setting a length in the aligning direction D1 of the overlapping portion 202 and the overlapping region 352 to L2, and a length in the aligning direction D1 of the single portion 201 and the single region 351 to L1, L1+L2=L3 is obtained.

As illustrated in FIG. 2, when there is a defective nozzle LN in the overlapping portion 202, a substitute nozzle RN0 which can form a dot DT0 in another pass (substitute pass) in the first raster RA1 in which a dot is to be formed using the defective nozzle LN is present. When there is only one substitute nozzle, it is also possible to set the substitute nozzle as a pair nozzle of the defective nozzle. A plurality of the substitute nozzles may be present, and a plurality of substitute passes may be present. When there is no error when transporting the matter for recording 400, it is possible to form a complementing dot using the substitute nozzle RN0. Dot complementation in which a complementing dot is formed using the substitute nozzle RN0 is referred to as "substitute nozzle complementation".

Subsequently, an example of a correlation between the nozzle 64 and the pixel PX will be described. The recording head 61 illustrated in FIG. 3 includes nozzles 64 of cyan (C), magenta (M), yellow (Y), and black (K). The head 61 may be provided in each color of CMYK. Order of colors of a nozzle column in the relative movement direction D2 is not limited. In FIG. 2, or the like, a head 61 of one color in CMYK is illustrated. In the nozzle column 68 of each color of the head 61, a plurality of nozzles which eject (discharge) ink droplets 67 are aligned in a predetermined aligning direction D1.

In addition, also in a nozzle column in which nozzles are arranged in zigzag, a plurality of nozzles are aligned, for example, in two columns in a predetermined aligning direction which is different from the relative movement direction, and it is included in the technology. The aligning direction in this case is an aligning direction of each nozzle of each column in the arrangement in zigzag.

The head 61 which is illustrated in FIG. 2, or the like, is schematically illustrated from a side opposite to a nozzle face with the nozzle 64 in order to match the printed image 330. In the nozzle column 68, there is a case in which a defective nozzle LN in which ink droplets are not ejected due to clogging, or the like, or ejected ink droplets do not draw a correct track is generated. When there is a defective nozzle LN, a "dot omission" region (first raster RA1) in which a dot missing pixel PXL in which a dot DT is not formed is continued in the relative movement direction D2 is formed in the matter for recording 400. That is, a dot missing pixel PXL due to a defective nozzle LN which is included in the plurality of nozzles 64, and is continued in the relative movement direction D2 is included in the plurality of pixels PX which configure an image 330 which is to be formed. When a dot is not formed in the first raster RA1, a stripe 800 (refer to image 339 in FIG. 1) of a ground color of the matter for recording 400 occurs in the printed image 330 along the relative movement direction D2. When the matter for recording 400 is white, a white stripe appears.

In the technology, a pass in which a defective nozzle LN is present in the overlapping portion 202 is referred to as a "target pass", and a pass in which it is possible to form a dot in another pass on the first raster RA1 in which recording is to be performed using the defective nozzle LN is referred to as a "substitute pass", a nozzle in which a dot is formed using a substitute pass on the first raster RA1 is referred to as a substitute nozzle RN0, nozzles which form a dot on the second raster RA2 neighboring the first raster RA1 in the aligning direction D1 are referred to as primary vicinity formation nozzles RN1 and RN2, nozzles which form a dot on a third raster RA3 neighboring the second raster RA2 on a side opposite to the first raster RA1 are referred to as secondary vicinity formation nozzles RN3 and RN4, vicinity pixels on both sides of the dot missing pixel PXL in the transport direction D3 are referred to as neighboring pixels PX1 and PX2, and vicinity pixels neighboring the neighboring pixels PX1 and PX2 on a side opposite to the dot missing pixel PXL from these neighboring pixels PX1 and PX2 are referred to as secondary neighboring pixels PX3 and PX4. Here, the nozzles RN1 and RN2 which form a dot on the second raster RA2 are collectively referred to as the vicinity formation nozzle RN10. The first raster RA1 is a region of a pixel PXL which is continued in the relative movement direction D2, the second raster RA2 is a region of neighboring pixels PX1 and PX2 which is continued in the relative movement direction D2, and the third raster RA3 is a region of the secondary neighboring pixels PX3 and PX4 which is continued in the relative movement direction D2. Dots DT0, DT1, DT2, DT3, and DT4 are formed on the pixels PXL, PX1, PX2, PX3, and PX4, respectively, using the ink droplets 67 which are ejected from the nozzles RN0, RN1, RN2, RN3, and RN4.

As exemplified in FIG. 1, in the technology, a method of complementing a dot to be formed using the defective nozzle LN is switched. "Complementation using substitute nozzle" illustrated in FIG. 1 is dot complementation in which complementing dot is formed using the substitute nozzle RN0, as described above. "Vicinity complementation" is dot complementation in which a complementing dot is formed using the vicinity formation nozzle RN10. "Combination complementation" is dot complementation in which the "Complementation using substitute nozzle", and the "vicinity complementation" are used in combination.

The recording apparatus 1 illustrated in FIG. 3 includes a controller 10, a Random Access Memory (RAM) 20, a non-volatile memory 30, a defective nozzle detection unit 48, a mechanism unit 50, interfaces (I/F) 71 and 72, an operation panel 73, and the like. The controller 10, the RAM 20, the non-volatile memory 30, the interfaces (I/F) 71 and 72, and the operation panel 73 are connected to a bus 80, and can perform an input and output of information each other.

The controller 10 includes a Central Processing Unit (CPU) 11, a resolution conversion unit 41, a color conversion unit 42, a halftoning processing unit 43, a plurality of complementing units U1, a rasterizing processing unit 45, a driving signal transmission unit 46, and the like. The controller 10 configures a defective nozzle detection portion U3 along with the defective nozzle detection unit 48. The controller 10 can be configured using a System on a Chip (SoC), or the like.

The CPU 11 is a device which mainly performs information processing or a control in the recording apparatus 1.

The resolution conversion unit 41 converts a resolution of an image which is input from a host device 100, a memory card 90, or the like, to a set resolution (for example, 600 dpi in transport direction D3, and 1200 dpi in relative movement direction D2). The input image is expressed using RGB data with integer values of 256 gradations of RGB (red, green, blue) in each pixel, for example.

The color conversion unit 42 converts RGB data with a set resolution into CMYK data with integer values of 256 gradations of CMYK in each pixel.

The halftoning processing unit 43 reduces the number of gradations of the gradation value by performing predetermined halftoning processing such as a dither method, an error diffusion method, a density pattern method, for example, with respect to a gradation value of each pixel which configures CMYK data, and generates halftone data before complementing a dot to be formed using the defective nozzle LN. The halftone data is data which denotes a formation situation of a dot, may be binary data which denotes whether or not a dot is formed, and may be multivalue data of three gradations or more which can correspond to dots with different sizes such as each dot of large, medium, and small. The binary data which can be expressed using one bit with respect to each pixel can be set to data which can cause 1 to correspond to a situation of forming a dot, and cause 0 to correspond to a situation of no dot. As four-value data which can be expressed using two bits with respect to each pixel, for example, it is possible to use data which causes 3 to correspond to a situation of forming a large dot, causes 2 to correspond to a situation of forming a medium dot, causes 1 to correspond to a situation of forming a small dot, and cause 0 to correspond to a situation of no dot. When a large dot is exclusively used in dot complementation, halftone data may be multivalue data in which a large dot is not formed.

The rasterizing processing unit 45 generates raster data (image data of pass unit) which performs rasterizing processing in which halftone data is realigned in order of forming a dot in the mechanism unit 50. The raster data is also data denoting a formation situation of dots, may be binary data, or may be multivalue data of three gradations or more.

In the overlapping portion 202, determining of a nozzle in passes to be used in each pixel can be performed, for example, by obtaining a logical product of a mask pattern and halftone data which are provided in each pass of the overlapping portion 202. As the mask pattern, for example, it is possible to set data which stores "1" in a portion in which halftone data is remained, and stores "0" in a portion in which halftone data is removed.

The rasterizing processing unit 45 which is illustrated in FIG. 3 includes a plurality of complementing units U1 which form a complementing dot for complementing a dot to be formed using the defective nozzle LN, and a selection unit U2 which selects any complementing unit U1 among the plurality of complementing units U1. Dot complementation using the complementing unit U1 may be performed before rasterizing processing, may be performed after the rasterizing processing, and may be performed at the same time as the rasterizing processing. When the dot complementation is performed before the rasterizing processing, halftone data becomes the original data 300 before dot complementation, and halftone data becomes recording data 310 after dot complementation. When the dot complementation is performed after the rasterizing processing, raster data becomes the original data 300 before dot complementation, and raster data after dot complementation becomes the recording data 310. When rasterizing processing and dot complementation are performed at the same time, halftone data becomes the original data 300 before dot complementation, and raster data becomes the recording data 310. In addition, when performing dot complementation, the recording data 310 may be generated by changing the above described mask pattern.

The plurality of complementing units U1 includes the substitute nozzle complementing unit U1*a*, the vicinity complementing unit U1*b*, and the combination complementing unit U1*c*. The substitute nozzle complementing unit U1*a* forms dot complementation on the first raster RA1 using the substitute nozzle RN0 without using the vicinity formation nozzle RN10. The substitute nozzle RN0 is to form a dot DT0*a* on the first raster RA1, and the defective nozzle LN is to form a dot DT0*b* on the first raster RA1, originally; however, in the example illustrated in FIG. 1, a situation in which the dot DT0*b* which is the latter is formed using the substitute nozzle RN0 is illustrated. The vicinity complementing unit U1*b* forms a complementing dot on the second raster RA2 using the vicinity formation nozzle RN10 without using the substitute nozzle RN0. The vicinity formation nozzle RN10 is to form a middle dot on the second raster RA2 on both sides of the first raster RA1; however, in the example illustrated in FIG. 1 illustrates a situation in which dots larger than the middle dot are formed as dots DT1 and DT2. In addition, both a dot which is newly formed with respect to a pixel in which a dot is not formed before complementation, and a dot which is largely formed with respect to a pixel in which a dot is formed before complementation are included in the complementing dots. The combination complementing unit U1*c* forms a complementing dot on the first raster RA1 using the substitute nozzle RN0, and on the second raster RA2 using the vicinity formation nozzle RN10.

In the selection unit U2 which is illustrated in FIG. 3, any one complementing unit is selected from among the above described complementing units U1*a*, U1*b*, and U1*c*, and the complementing unit U1 is caused to execute a complementing process of generating the recording data 310 in which a dot is complemented based on the original data 300. As a matter of course, also the recording data 310 is data which denotes a formation situation of dots, may be binary data, and may be a multivalue data with three gradations or more. The selection unit U2 can select the complementing unit based on an amount δ of sending error (error which occurs when matter for recording 400 moves toward transport direction D3) of the matter for recording 400. The error amount δ is set to a number of 0 or more by setting a state of no error to a reference, and in both a case in which an error on the upstream side in the transport direction becomes large and a case in which an error on the downstream side becomes large, it is assumed the error amount δ is large.

In the example in FIG. 1 in which there is a dot to be formed using the defective nozzle LN at an end portion of the overlapping portion 202, when the error amount δ is small, for example, is a threshold value TH1 or less, the substitute nozzle complementing unit U1*a* is selected, and the printed image 331 which is obtained by forming the complementing dot DT0*b* on the first raster RA1 using the substitute nozzle RN0 is illustrated. Here, when only complementing using the substitute nozzle is performed in a case in which the error amount δ exceeds the threshold value TH1, the stripe 800 which goes along the relative movement direction D2 occurs in a printed image 339, since a dot forming position on one side on the second raster RA2 and a dot forming position on the first raster RA1 are separated from each other. Therefore, by performing vicinity complementation by selecting the vicinity complementing unit U1*b* when the error amount δ exceeds the threshold value TH1, and by forming large dots (complementing dots DT1 and DT2) on the second raster RA2 using the vicinity formation nozzle RN10, it is possible to make the stripe 800 not attract attention on a printed image 332. However, when only the vicinity complementation is performed in a case of a larger error amount δ, for example, the error amount exceeds a threshold value TH2, the stripe 800 attracts attention again. Therefore, it is possible to make the stripe 800 not attract attention on a printed image 333 by performing both the vicinity complementation and complementation using the substitute nozzle by selecting the combination complementing unit U1*c* when the error amount δ exceeds the threshold value TH2, forming a large dot (complementing dot DT1) on the second raster RA2, and forming the complementing dot DT0*b* on the first raster RA1. In addition, in the printed image 333 which is illustrated in FIG. 1, the complementing dot DT2 is not formed in a neighboring pixel PX2 illustrated in FIG. 2; however, the complementing dot DT2 may also be formed.

In the example illustrated in FIG. 5 in which a defective nozzle LN is present inside the overlapping portion 202, as illustrated in parenthesis, a raster in which a ratio of dot number in each pass is not to set to 1:1 is provided with respect to an overlapping region 352. In FIG. 5, the overlapping region 352 with passes P1 and P2 are exemplified; however, dots of each pass are formed with the same ratio also in the overlapping region 352 after the pass P2 and a pass P3. Also in the example in FIG. 5, a printed image 331 in which the substitute nozzle complementing unit U1*a* is selected when the error amount δ is small, for example, is the threshold value TH1 or less, and the complementing dot DT0*b* is formed on the first raster RA1 using the substitute nozzle RN0 is illustrated. When substitute nozzle complementation is only performed in a case in which the error amount δ exceeds the threshold value TH1, the stripe 800 which goes along the relative movement direction D2 occurs in a printed image 339, since a dot formation position on one side on the second raster RA2 and a dot forming position on the first raster RA1 are separated from each other. Therefore, it is possible to make the stripe 800 not attract attention in the printed image 332 by performing vicinity complementation by selecting the vicinity complementing unit U1*b* when the error amount δ exceeds the threshold value TH1, and forming large dots (complementing dots DT1 and DT2) on the second raster RA2 using the vicinity formation nozzle RN10. However, in a case in which only the vicinity complementation is performed when the error amount δ exceeds the threshold value TH2 which is larger, the stripe 800 attracts attention again. Therefore, when the error amount δ exceeds the threshold value TH2, it is possible to make the stripe 800 not attract attention on a printed image 333 by performing both the vicinity complementation and the substitute nozzle complementation by selecting the combination complementing unit U1*c*, forming large dots (complementing dots DT1 and DT2) on the second raster RA2, and forming the complementing dot DT0*b* on the first raster RA1.

Figure 8:
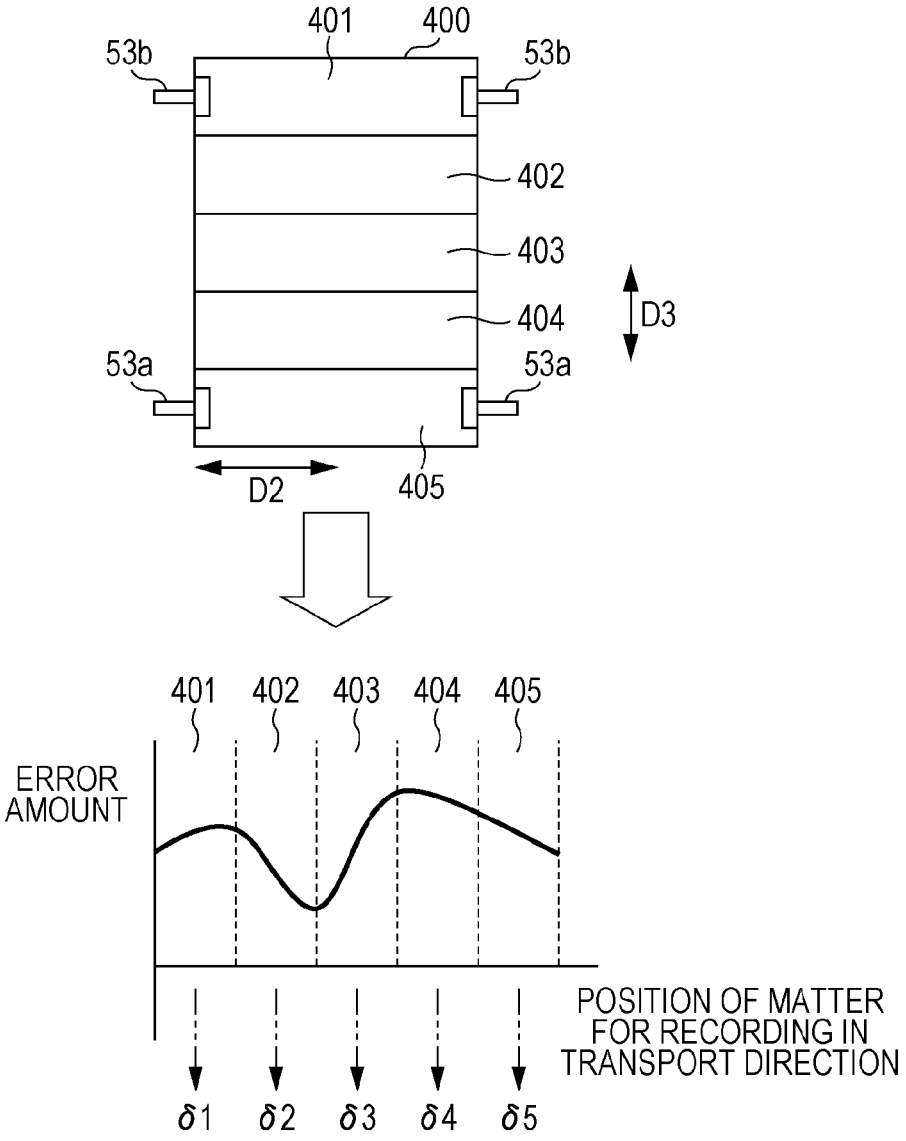
FIG. 8 is a diagram which schematically illustrates an example of setting an error amount in each region of a matter for recording.

The error amount δ may be set in each region of the matter for recording 400 as exemplified in FIG. 8. When transporting the matter for recording 400 in the transport direction D3, there is a case in which, first, the matter for recording is interposed between sheet feeding rollers 53*a* on the upstream side in the transport direction from the head 61, is interposed between sheet discharging rollers 53*b* on the downstream side in the transport direction from the head 61, is released from the interposing state of the sheet feeding rollers 53*a*, and is released from the interposing state of the sheet discharging rollers 53*b*, finally. There is a case in which a transport speed of the matter for recording 400 when being transported by only being interposed between the sheet feeding rollers 53*a*, and a transport speed of the matter for recording 400 when being transported by only being interposed between the sheet discharging rollers 53*b* are slightly different from each other. In this case, there is a case in which an error amount is changed according to a position of the matter for recording 400 in the transport direction D3. Therefore, it is possible to select any of complementing unit U1 based on each error amounts δ1 to δ5 of each region, by dividing a region on the matter for recording into a plurality of regions of 401 to 405 in the transport direction D3, and by obtaining the error amounts δ1 to δ5 of each region by averaging amounts of sending error of the matter for recording 400 with respect to each of regions 401 to 405. In this manner, it is possible to further appropriately complement a dot to be formed using the defective nozzle LN.

In addition, as specific processing of selecting any complementing unit U1 based on the error amount δ which will be described later with reference to FIGS. 10 to 12.

The driving signal transmission unit 46 generates a driving signal SG corresponding to a voltage signal which is applied to a driving element 63 of the head 61 from a raster, and outputs the signal to a driving circuit 62. For example, when the recording data 310 denotes "forming of large dot", a driving signal for ejecting ink droplets for a large dot is output, when the recording data 310 denotes "forming of medium dot", a driving signal for ejecting ink droplets for a medium dot is output, and when the recording data 310 denotes "forming of small dot", a driving signal for ejecting ink droplets for a small dot is output.

The above described each unit 41 to 43, 45, and 46 may be configured using an Application Specific Integrated Circuit (ASIC), or it may be a configuration in which data as a processing target is directly read from the RAM 20, or data after being processed is directly written in the RAM 20.

The mechanism unit 50 which is controlled by the controller 10 includes a carriage motor 51, a sheet feeding mechanism 53, a carriage 60, the head 61, and the like. The carriage motor 51 causes the carriage 60 to reciprocate in the relative movement direction D2 through a plurality of tooth gears and a belt 52 which are not illustrated. The sheet feeding mechanism 53 transports the matter for recording 400 in the transport direction D3. The head 61 which ejects ink droplets 67 of CMYK, for example, is mounted on the carriage 60. The head 61 includes a driving circuit 62, a driving element 63, and the like. The driving circuit 62 applies a voltage signal to the driving element 63 according to the driving signal SG input from the controller 10. As the driving element 63, it is possible to use a piezoelectric element which applies a pressure to ink (liquid) 66 in a pressure chamber which communicates with the nozzle 64, a driving element which causes the ink droplets 67 to be ejected from the nozzle 64 by generating air bubbles in the pressure chamber using heat, or the like. The ink 66 is supplied to the pressure chamber of the head 61 from an ink cartridge (liquid cartridge) 65. A combination of the ink cartridge 65 and the head 61 is provided in each CMYK, for example. The ink 66 in the pressure chamber is ejected as the ink droplets 67 toward the matter for recording 400 from the nozzle 64 using the driving element 63, and a dot DT of the ink droplets 67 is formed on the matter for recording 400 such as a printing sheet, or the like. When the head 61 moves in the relative movement direction D2, that is, when the plurality of nozzles 64 and the matter for recording 400 relatively move in the relative movement direction, the printed image 330 corresponding to the recording data 310 is formed using the plurality of dots DT. When multivalue data is four-value data, the image 330 is printed due to a formation of dots corresponding to a dot size which is expressed using the multivalue data.

The RAM 20 is a volatile semiconductor memory with a large capacity, and a program PRG2, the original data 300, the recording data 310, and the like, are stored therein. The program PRG2 includes a recording program which causes the recording apparatus 1 to execute a complementing function, a selecting function, and a function of detecting a defective nozzle corresponding to each of units U1 to U3 of the recording apparatus 1.

The program data PRG1, information corresponding to the amount δ of error which occurs in one transporting operation of the matter for recording 400 which is intermittently transported at a time of overlapping printing, and the like, are stored in the non-volatile memory 30. For example, a worker in a manufacturing factory of the recording apparatus performs an operation of storing the error amount δ in the non-volatile memory 30 by measuring the error amount. As a matter of course, a user of the recording apparatus may perform the operation of storing the error amount δ in the non-volatile memory 30 by measuring the error amount. As the non-volatile memory 30, a Read Only Memory (ROM), a magnetic recording medium such as a hard disk, or the like, is used. In addition, when developing the program data PRG1, it means that the program is written in the RAM 20 as a program which can be interpreted in the CPU 11.

The card I/F 71 is a circuit which writes data in the memory card 90, or reads data from the memory card 90. The memory card 90 is a non-volatile semiconductor memory in which writing and removing of data is possible, and in which an image, or the like, which is photographed using a photographing device such as a digital camera is stored. The image is expressed using a pixel value of an RGB color space, for example, and each pixel value of RGB is expressed using gradation values of 0 to 255 of eight bits, for example.

The communication I/F 72 is connected to a communication I/F 172 of the host device 100, and performs inputting or outputting of information with respect to the host device 100. It is possible to use a Universal Serial Bus (USB), or the like, as the communication I/F 72, and the communication I/F 172. A computer such as a personal computer, a digital camera, a digital video camera, a mobile phone such as a smart phone, and the like, are included in the host device 100.

The operation panel 73 includes an output unit 74, an input unit 75, or the like, and it is possible to input various instructions with respect to the recording apparatus 1 by a user. The output unit 74 is configured of, for example, a liquid crystal panel (display unit) which displays information corresponding to various instructions, and information denoting a state of the recording apparatus 1. The output unit 74 may output the information using sound. The input unit 75 is configured of, for example, an operation key (operation input unit) such as a cursor key, or a determination key. The input unit 75 may be a touch panel, or the like, which receives an operation with respect to a display screen.

The defective nozzle detection unit 48 configures a defective nozzle detection portion U3 which detects whether or not a state of each nozzle 64 is normal along with the controller 10.

Figure 6A:
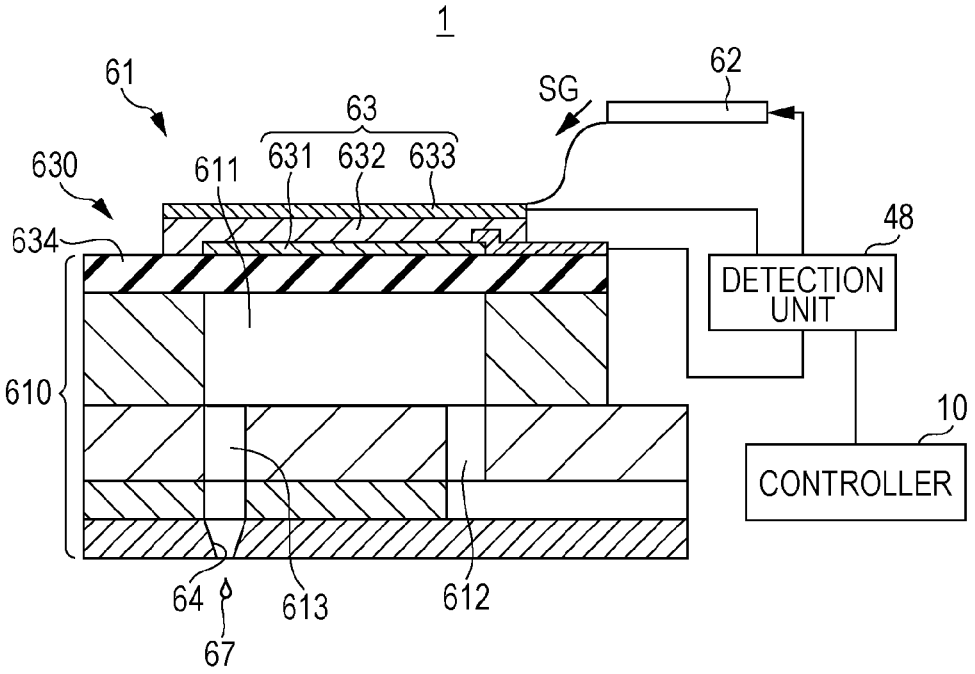
FIG. 6A is a diagram which schematically exemplifies main parts of the recording apparatus.
Figure 6B:
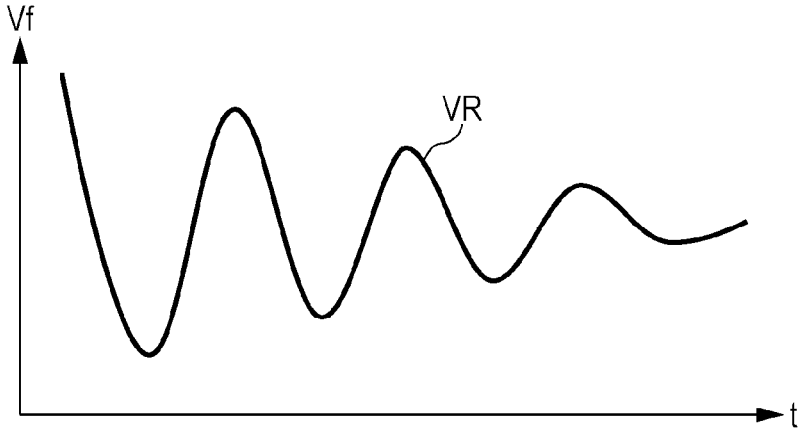
FIG. 6B is a diagram which schematically exemplifies an electromotive force curve based on residual vibration of a vibrating plate.
Figure 7A:
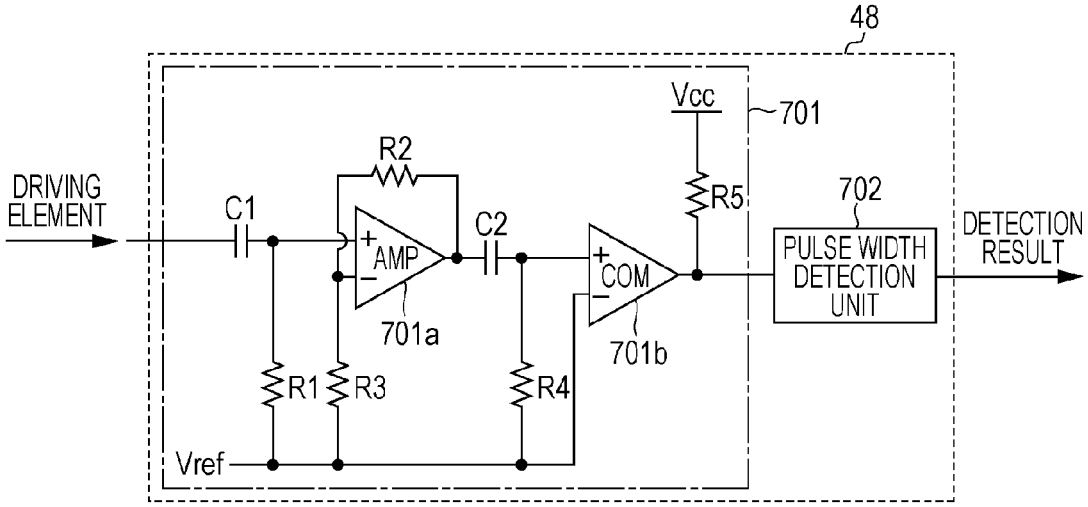
FIG. 7A is a diagram which illustrates an example of an electric circuit of a defective nozzle detection unit.
Figure 7B:
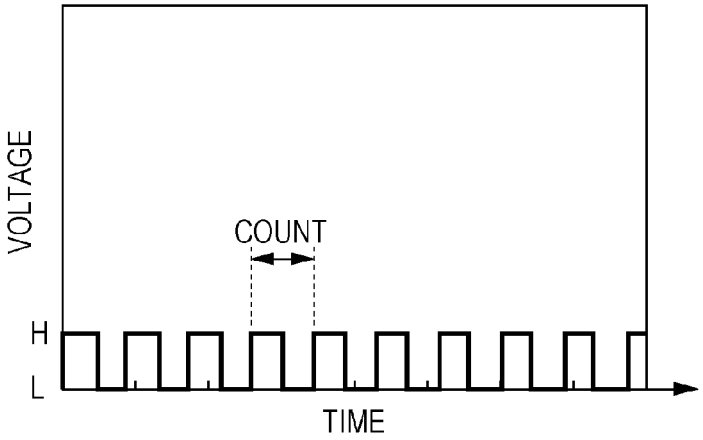
FIG. 7B is a diagram which schematically illustrates an example of an output signal from an amplification unit.

FIGS. 6A and 6B are diagrams for describing an example of a method of detecting a state of the nozzle 64. FIG. 6A schematically illustrates main parts of the recording apparatus 1, and FIG. 6B schematically illustrates an electromotive force curve VR based on residual vibration of a vibrating plate 630. FIG. 7A is a diagram which illustrates an example of an electric circuit of the detection unit 48, and FIG. 7B is a diagram which schematically illustrates an example of an output signal from a comparator 701*b*.

A pressure chamber 611, an ink supply path 612 through which the ink 66 flows from the ink cartridge 65 to the pressure chamber 611, a nozzle communication path 613 through which the ink 66 flows from the pressure chamber 611 to the nozzle 64, and the like, are formed on a flow path substrate 610 of the head 61 which is illustrated in FIG. 6A. In the flow path substrate 610, it is possible to use, for example, a silicon substrate, or the like. The front surface of the flow path substrate 610 is set to a vibrating plate unit 634 which configures a part of a wall face of the pressure chamber 611. The vibrating plate unit 634 can be configured of, for example, silicon oxide, or the like. A vibrating plate 630 can be configured of, for example, the vibrating plate unit 634, the driving element 63 which is formed on the vibrating plate unit 634, or the like. The driving element 63 can be set to a piezoelectric element, or the like, which includes, for example, a lower electrode 631 which is formed on the vibrating plate unit 634, a piezoelectric layer 632 which is formed mainly on the lower electrode 631, and a higher electrode 633 which is mainly formed on the piezoelectric layer 632. It is possible to use, for example, platinum, gold, or the like, in the electrodes 631 and 633. In the piezoelectric layer 632, it is possible to use, for example, a perovskite type oxide of a ferroelectric substance such as lead zirconate titanate (PZT, $Pb(Zr_x, Ti_{1-x})O_3$ in stoichiometric ratio), or the like.

FIG. 6A illustrates main parts of the recording apparatus 1 which is provided with the detection unit 48 which detects a state of an electromotive force from the piezoelectric element (driving element 63) based on residual vibration of the vibrating plate 630 using a block diagram. One end of the detection unit 48 is electrically connected to the lower electrode 631, and the other end of the detection unit 48 is electrically connected to the higher electrode 633.

FIG. 6B exemplifies an electromotive force curve (state of electromotive force) VR of the driving element 63 based on residual vibration of the vibrating plate 630 which is generated after supplying the driving signal SG for ejecting the ink droplets 67 from the nozzle 64. Here, a horizontal axis denotes a time t, and a vertical axis denotes an electromotive force Vf. The electromotive force curve VR illustrates an example in which the ink droplets 67 are ejected from a normal nozzle 64. When the ink droplets 67 are not ejected from a nozzle, or ejected ink droplets 67 do not draw a correct track due to clogging, or the like, the electromotive force curve deviates from VR. Therefore, it is possible to detect whether a nozzle 64 is normal or defective using a detecting circuit which is illustrated in FIG. 7A.

The detection unit 48 which is illustrated in FIG. 7A includes an amplification unit 701, and a pulse width detection unit 702. The amplification unit 701 includes, for example, an operational amplifier 701*a*, a comparator 701*b*, capacitors C1 and C2, and resistors R1 to R5. When the driving signal SG which is output from the driving circuit 62 is applied to the driving element 63, residual vibration is generated, and an electromotive force based on the residual vibration is input to the amplification unit 701. A low frequency component which is included in the electromotive force is eliminated using a high pass filter which is configured of the capacitor C1 and the resistor R1, and the electromotive force after eliminating the low frequency component is amplified at a predetermined amplification rate using the operational amplifier 701*a*. An output of the operational amplifier 701*a* passes through the high pass filter which is configured of the capacitor C2 and the resistor R4, is compared to a reference voltage Vref using the comparator 701*b*, and is converted into a pulse-like voltage of a high level H or a low level L depending on whether or not the output is higher than the reference voltage Vref.

FIG. 7B illustrates an example of a pulse-like voltage which is output from the comparator 701*b*, and is input to the pulse width detection unit 702. The pulse width detection unit 702 resets a count value at a time of rising of the pulse-like voltage which is input, increases the count value in every predetermined period, and outputs the count value in the subsequent rising time of the pulse-like voltage as a detection result to the controller 10. The count value corresponds to a cycle of the electromotive force based on the residual vibration, and a count value which is sequentially output denotes frequency characteristics of the electromotive force based on the residual vibration. Frequency characteristics (for example, a cycle) of an electromotive force when a nozzle is a defective nozzle LN are different from frequency characteristics of an electromotive force when a nozzle is normal. Therefore, the controller 10 can determine that a nozzle as a detection target is normal when a count value which is sequentially input is in an allowable range, and can determine that a nozzle as the detection target is a defective nozzle LN when a count value which is sequentially input is out of the allowable range.

The controller 10 can grasp a state of each nozzle 64 by performing the above described process with respect to each nozzle 64, and to store information which denotes a position of the defective nozzle LN in the RAM 20, or the non-volatile memory 30, for example.

As a matter of course, a method of detecting the defective nozzle LN is not limited to the above described method. For example, a method of ejecting ink droplets 67 from the plurality of nozzles 64 while sequentially switching a target nozzle, and receiving an operation input of information (for example, nozzle number) for identifying a nozzle which does not form a dot on the matter for recording 400 is also included in detecting of the defective nozzle LN. In addition, when information for identifying the defective nozzle LN is stored in the non-volatile memory 30, for example, before shipping from a manufacturing factory, it is not necessary to provide the defective nozzle detection portion U3 in the recording apparatus 1.

Figure 9:
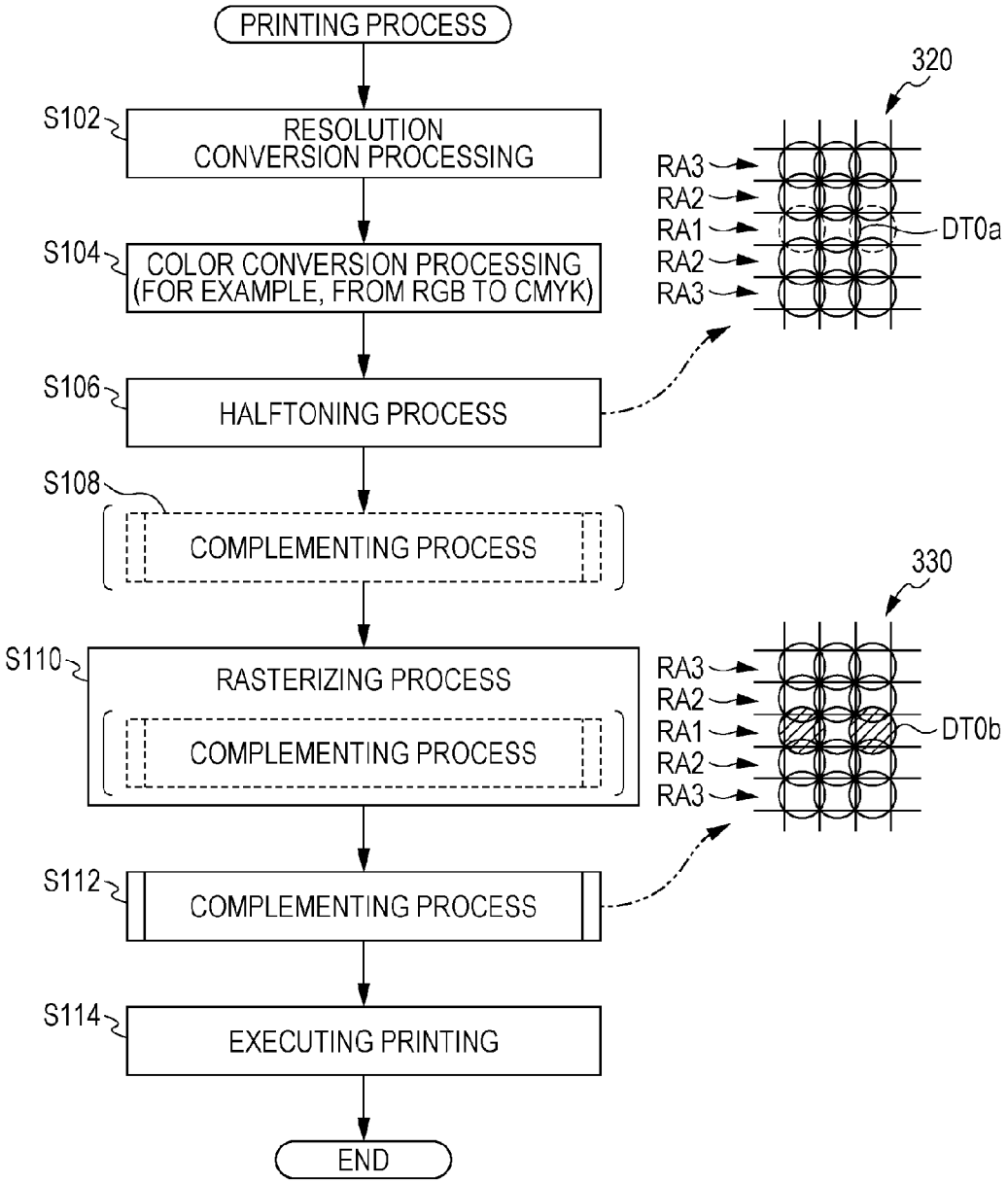
FIG. 9 is a flowchart which illustrates an example of a printing process.

FIG. 9 illustrates an example of a printing process which is performed in the recording apparatus 1 using a flowchart. Processes in steps S102 to S114 in which the image 330 is formed based on an input image from the host device 100, the memory card 90, or the like, are sequentially performed by the above described each unit 41 to 43, 45, 46, and 50. Hereinafter, a description of "step" will be omitted. The printing process may be executed using the electric circuit, or may be executed using a program.

First, a case of performing a complementing process after the rasterizing process will be described.

When the printing process is started, the resolution conversion unit 41 converts RGB data (for example, 256 gradations) which denotes an input image into a set resolution (for example, 600×1200 dpi) (S102). The color conversion unit 42 performs a color conversion of the RGB data with the set resolution into CMYK data (for example, 256 gradations) with the same set resolution (S104). The halftoning processing unit 43 generates halftone data by performing a halftoning process with respect to the CMYK data (S106). The rasterizing processing unit 45 performs predetermined rasterizing processing with respect to the halftone data, rearranges the halftone data in order of forming a dot using the mechanism unit 50, and generates raster data of respective CMYK (S110). Thereafter, complementing process is performed using the complementing unit U1 and the selection unit U2, and raster data (recording data 310) of which a dot is complemented is generated from raster data (original data 300) before dot complementation (S112). The driving signal transmission unit 46 generates a driving signal SG corresponding to raster data, outputs the signal to the driving circuit 62 of the head 61, and execute printing by causing ink droplets 67 to be ejected from the nozzle 64 of the head 61, by driving the driving element 63 in accordance with the raster data (S114). In this manner, a printed image of a multivalue (four value, for example) which is expressed in a formation situation of dots on the matter for recording 400 is formed, and the printing process is completed.

FIG. 10 illustrates an example of a complementing process which is performed in S112 in the first technology using a flowchart. When the complementing process is started, the selection unit U2 branches processes by comparing an amount of sending error δ of the matter for recording 400 to threshold values TH1 and TH2 (TH1<TH2) (S202). In the process, substitute nozzle complementation may be selected when the error amount δ is in a first allowable range (for example, δ≤TH1), combination complementation may be selected when the error amount δ in out of the second allowable range (for example, TH2<δ), and vicinity complementation may be selected when the error amount is out of the first allowable range, and in the second allowable range (for example, TH1<δ≤TH2). In addition, the range in the first allowable range may be δ<TH1, the range in the second allowable range may be TH2≤δ, and the range out of the first allowable range and in the second allowable range may be TH1≤δ<TH2. Here, the second allowable range corresponds to a "predetermined allowable range" in which whether or not to select the combination complementing unit U1*c* is determined.

The substitute nozzle complementing unit U1*a* which is selected when the error amount δ is in the first allowable range performs substitute nozzle complementation which forms a complementing dot on the first raster RA1 using the substitute nozzle RN0 without using the vicinity formation nozzle RN10 (S204). In this manner, as illustrated in FIGS. 1 and 5, the complementing dot DT0*b* is formed using the substitute nozzle RN0 with respect to the first raster RA1 which is to be recorded using the defective nozzle LN. A size of the formed complementing dot DT0*b* is set to be the same size as that of a dot to be formed using the defective nozzle LN (for example, medium dot). When a sending error of the matter for recording 400 is small, in particular, a dot to be formed using the defective nozzle LN is preferably complemented, by forming the complementing dot DT0*b* on the first raster RA1 which is to be recorded using the defective nozzle LN.

The vicinity complementing unit U1*b* which is selected when the error amount δ is out of the first allowable range and in the second allowable range performs vicinity complementation in which a complementing dot is formed on the second raster RA2 using the vicinity formation nozzle RN10 without using the substitute nozzle RN0 (S206). In this manner, as illustrated in FIGS. 1 and 5, complementing dots DT1 and DT2 are formed using the vicinity formation nozzle RN10 on the second raster RA2 neighboring the first raster RA1 which is to be recorded using the defective nozzle LN. The formed dots DT1 and DT2 are set to be dots (for example, large dots) larger than dots of neighboring pixels PX1 and PX2 (second raster RA2. Refer to FIG. 2) when dot complementation is not performed. When a sending error of the matter for recording 400 becomes large to some extent, the stripe 800 attracts attention when only the substitute nozzle complementation is performed; however, by forming the complementing dots DT1 and DT2 on the second raster RA2 neighboring the first raster RA1, in particular, a dot to be formed using the defective nozzle LN is preferably complemented.

In addition, an example of vicinity complementation will be described with reference to FIG. 2. The vicinity complementation can be performed according to the following rule, for example. Pixels PXL, and PX1 to PX4 in this rule are pixels at the same position in the relative movement direction D2.

(Rule 1) When both pixels PXL and PX1 of the original data 300 are "1" (formation of small dot) or "2" (formation of medium dot), 1 is added to data of the neighboring pixel PX1, and a dot omission pixel PXL is changed to "0" (no dot). When the neighboring pixel PX1 after complementation is "3" (formation of large dot), and "2" is stored in the secondary neighboring pixel PX3 of the original data 300, the secondary neighboring pixel PX3 is changed to "1".

(Rule 2) When both pixels PXL and PX2 of the original data 300 are "1" or "2", 1 is added to data of the neighboring pixel PX2, and the dot omission pixel PXL is changed to "0" (no dot). When the neighboring pixel PX2 after complementation is "3", and "2" is stored in the secondary neighboring pixel PX4 of the original data 300, the secondary neighboring pixel PX4 is changed to "1".

(Rule 3) When the dot omission pixel PXL is "1" or "2" in the original data 300, and both the neighboring pixels PX1 and PX2 are "0", the neighboring pixel PX1 is changed to data of the dot omission pixel PXL, and the dot omission pixel PXL is changed to "0".

(Rule 4) When the dot omission pixel PXL of the original data 300 is "0", data items of the pixels PXL, and PX1 to PX4 are not changed.

For example, in the original data 300, it is set such that the dot omission pixel PXL is "2" (formation of medium dot), and the neighboring pixel PX1 neighboring the dot omission pixel PXL is also "2". In this case, in the recording data 310 which is subjected to the vicinity complementation process, the dot omission pixel PXL is "0" (no dot), and the neighboring pixel PX1 neighboring the dot omission pixel PXL is "3" (formation of large dot). The large dot is a complementing dot which is changed from the medium dot. In addition, the secondary neighboring pixel PX3 neighboring the neighboring pixel PX1 is changed from "2" to "1" (formation of small dot) in the original data 300.

In addition, in the original data 300, it is set such that the dot omission pixel PXL is "2", and the neighboring pixel PX1 neighboring the dot omission pixel PXL is "0". In this case, in the recording data 310 which is subjected to the dot complementation, the dot omission pixel PXL is "0", and the neighboring pixel PX1 neighboring the dot omission pixel PXL is "2" (formation of medium dot). The newly formed medium dot is a complementing dot.

In addition, in the original data 300, it is set such that the dot omission pixel PXL is "0", and the neighboring pixel PX1 neighboring the dot omission pixel PXL is "2". In this case, in the recording data 310 which is subjected to dot complementation, the dot omission pixel PXL is "0" without being changed, and the neighboring pixel PX1 neighboring the dot omission pixel PXL is "2" without being changed.

As a matter of course, the technology is not limited to the above described rules. For example, the neighboring pixel PX1 may be changed to "3" in the rule 1, and the neighboring pixel PX2 may be changed to "3" in the rule 2.

Meanwhile, the combination complementing unit U1*c* which is selected when the error amount δ is out of the second allowable range performs combination complementation in which a complementing dot is formed on the first raster RA1 using the substitute nozzle RN0, and on the second raster RA2 using the vicinity formation nozzle RN10 (S208). In this manner, as illustrated in FIGS. 1 and 5, the complementing dot DT0*b* (for example, medium dot) is formed with respect to the first raster RA1 which is to be recorded using the defective nozzle LN using the substitute nozzle RN0, and complementing dots DT1 and DT2 (for example, large dots) are formed with respect to the second raster RA2 neighboring the first raster RA1 using the vicinity formation nozzle RN10. When a sending error of the matter for recording 400 becomes larger, the stripe 800 attracts attention when only the vicinity complementation is performed; however, by forming the complementing dot DT0*b* on the first raster RA1, in particular, a dot to be formed using the defective nozzle LN is preferably complemented.

FIG. 11 illustrates an example of another complementing process which is performed in S112 in the first technology. When the complementing process is started, the selection unit U2 branches the process by comparing the error amount δ to the threshold value TH3 (S202). In the process, when the error amount δ is in a predetermined allowable range (for example, δ≤TH3), substitute nozzle complementation may be selected, and when the error amount δ is out of the allowable range (for example, TH3<δ), combination complementation may be selected. In addition, "in predetermined allowable range" may be δ<TH3, and "out of allowable range" may be TH3≤δ.

The substitute nozzle complementing unit U1*a* which is selected when the error amount δ is in the predetermined allowable range performs the substitute nozzle complementation in which a complementing dot is formed on the first raster RA1 using the substitute nozzle RN0 without using the vicinity formation nozzle RN10 (S204). When a sending error of the matter for recording 400 is small, a dot to be formed using the defective nozzle LN is preferably complemented, particularly, when the complementing dot DT0*b* is formed on the first raster RA1 which is to be recorded using the defective nozzle LN.

The combination complementing unit U1*c* which is selected when the error amount δ is out of the allowable range performs combination complementation in which a complementing dot is formed on the first raster RA1 using the substitute nozzle RN0, and on the second raster RA2 using the vicinity formation nozzle RN10. (S208). When a sending error of the matter for recording 400 is large to some extent, the stripe 800 attracts attention when only the substitute nozzle complementation is performed; however, by forming the complementing dots DT1 and DT2 on the second raster RA2 neighboring the first raster RA1, in particular, the dot to be formed using the defective nozzle LN is preferably complemented.

FIG. 12 illustrates an example of a complementing process which is performed in S112 in the second technology. When the complementing process is started, the selection unit U2 branches the process by comparing the error amount δ to a threshold value TH4 (S202). In the process, the vicinity complementation may be selected when the error amount δ is in a predetermined allowable range (for example, δ≤TH4), and the combination complementation may be selected when the error amount δ is out of the allowable range (for example, TH4<δ). In addition, "in predetermined allowable range" may be δ<TH4, and "out of the allowable range" may be TH4≤δ.

The vicinity complementing unit U1*b* which is selected when the error amount δ is in the predetermined allowable range performs vicinity complementation in which a complementing dot is formed on the second raster RA2 using the vicinity formation nozzle RN10 without using the substitute nozzle RN0 (S206). When a sending error of the matter for recording 400 is small, in particular, the dot to be formed using the defective nozzle LN is preferably complemented by forming the complementing dots DT1 and DT2 on the second raster RA2 neighboring the first raster RA1 which is to be recorded using the defective nozzle LN.

The combination complementing unit U1*c* which is selected when the error amount δ is out of the allowable range performs combination complementation in which a complementing dot is formed on the first raster RA1 using the substitute nozzle RN0, and on the second raster RA2 using the vicinity formation nozzle RN10 (S208). When a sending error of the matter for recording 400 becomes large to some extent, the stripe 800 attracts attention when only the vicinity complementation is performed; however, by forming the complementing dot DT0*b* on the first raster RA1, in particular, the dot to be formed using the defective nozzle LN is preferably complemented.

In the printing process which is illustrated in FIG. 9, complementing process may be performed before the rasterizing process (S110) (S108). In this case, complementing process is performed using the complementing unit U1 and the selection unit U2, and halftone data (recording data 310) with which a dot is complemented is generated from halftone data (original data 300) before dot complementation (S112).

In addition, in the printing process which is illustrated in FIG. 9, the complementing process may be performed simultaneously with the rasterizing process (S110). In this case, the complementing process is performed with the rasterizing process using the complementing unit U1 and the selection unit U2, and the halftone data (recording data 310) with which a dot is complemented is generated from the halftone data (original data 300) before dot complementation.

As described above, when it is possible to sufficiently complement the dot to be formed using the defective nozzle LN using only the substitute nozzle complementation, the complementing dot DT0*b* is formed on the first raster RA1 using the substitute nozzle RN0 without being formed using the vicinity formation nozzle RN10, by selecting the substitute nozzle complementing unit U1*a*. In this manner, excessive complementation is suppressed. In addition, when it is not possible to sufficiently complement the dot to be formed using the defective nozzle LN using vicinity complementation, the complementing dots DT1 and DT2 are formed on the second raster RA2 using the vicinity formation nozzle RN10 without being formed using the substitute nozzle RN0, by selecting the vicinity complementing unit U1*b*. In this manner, excessive complementation is suppressed. In addition, when complementation is not sufficient even when vicinity complementation is performed, a complementing dot is formed on the first raster RA1 using the substitute nozzle RN0, and is also formed on the second raster RA2 using the vicinity formation nozzle RN10 by selecting the combination complementing unit U1*c*. Accordingly, in the recording apparatus 1, it is possible to improve the effect of complementing a dot to be formed using the defective nozzle LN. In addition, since the substitute nozzle complementing unit U1*a* or the vicinity complementing unit U1*b* is selected when an amount δ of a sending error of the matter for recording 400 is small, and the combination complementing unit U1*c* is selected when the error amount δ is large, the dot to be formed using the defective nozzle LN is further appropriately complemented.

In addition, it is possible to apply the technology when there is an overlapping portion of a nozzle between scanning operations. Accordingly, it is also possible to apply the technology to a recording apparatus which performs full overlapping printing in which all of nozzles become overlapping portions, not only to a recording apparatus which performs partial overlapping printing.

(3) SPECIFIC EXAMPLES OF THIRD AND FOURTH TECHNOLOGIES

In addition, the technology can also be applied to a line printer which is illustrated in FIGS. 13 to 18.

Figure 14:
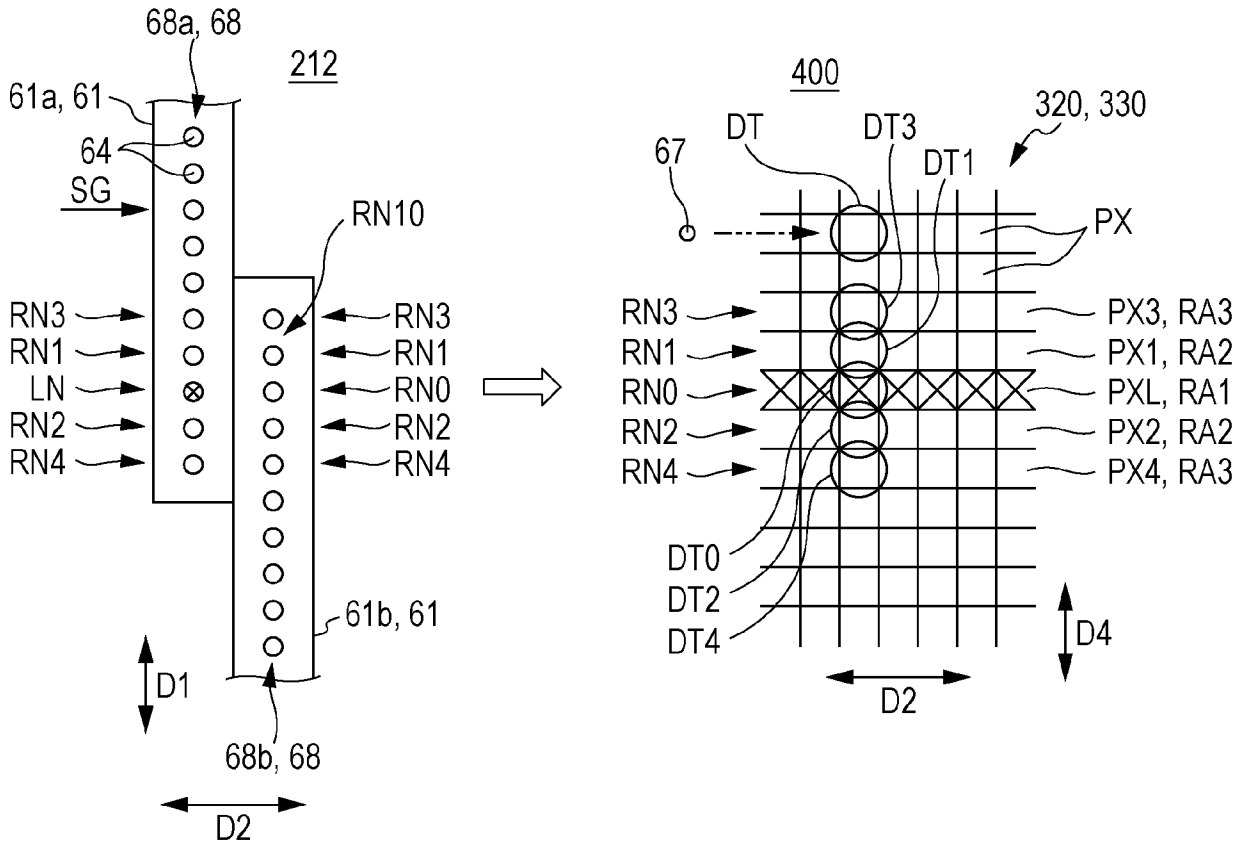
FIG. 14 is a diagram which schematically illustrates an example of a correlation between a nozzle and a pixel.
Figure 15:
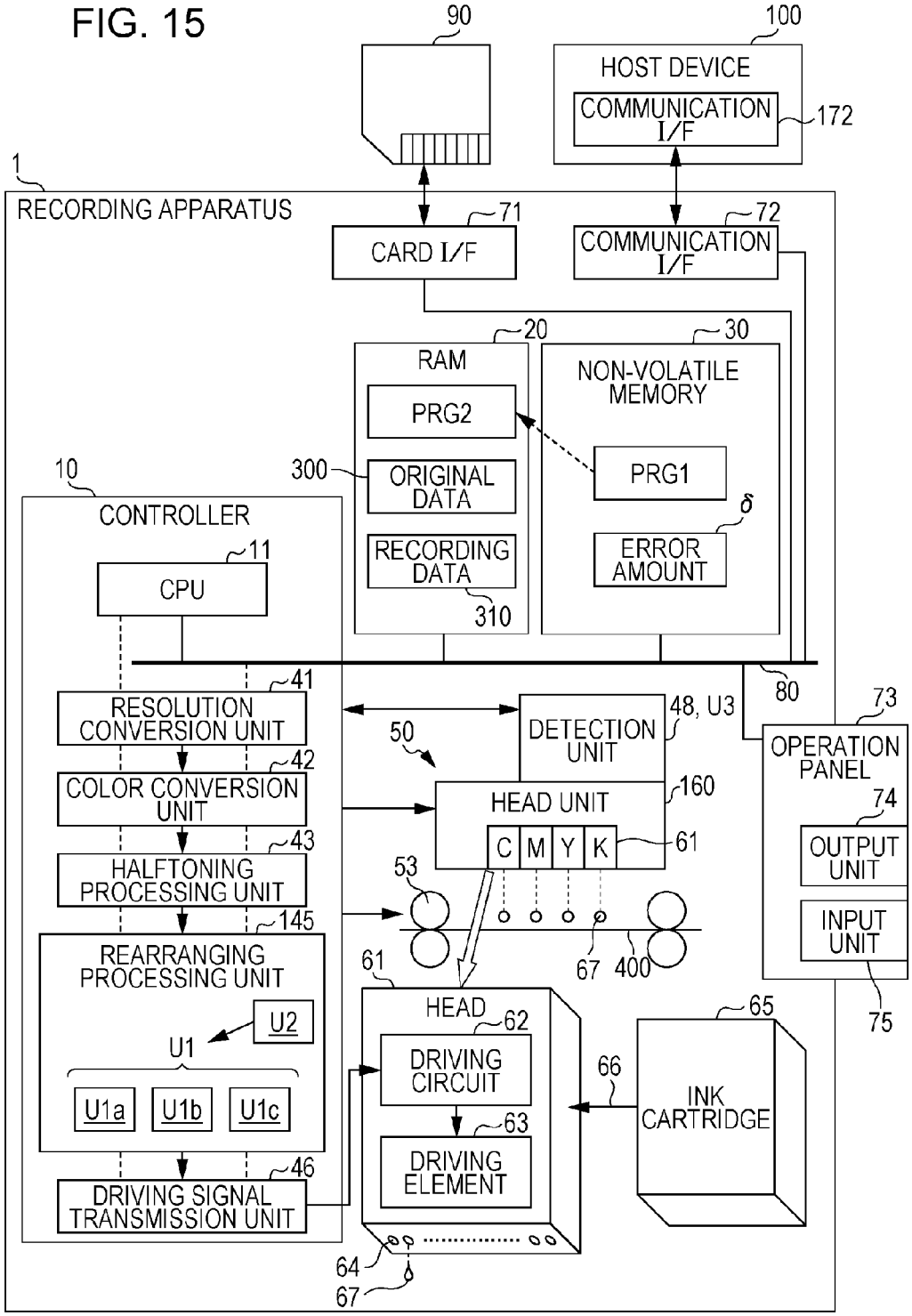
FIG. 15 is a diagram which schematically illustrates a configuration example of a line printer as the recording apparatus.
Figure 16:
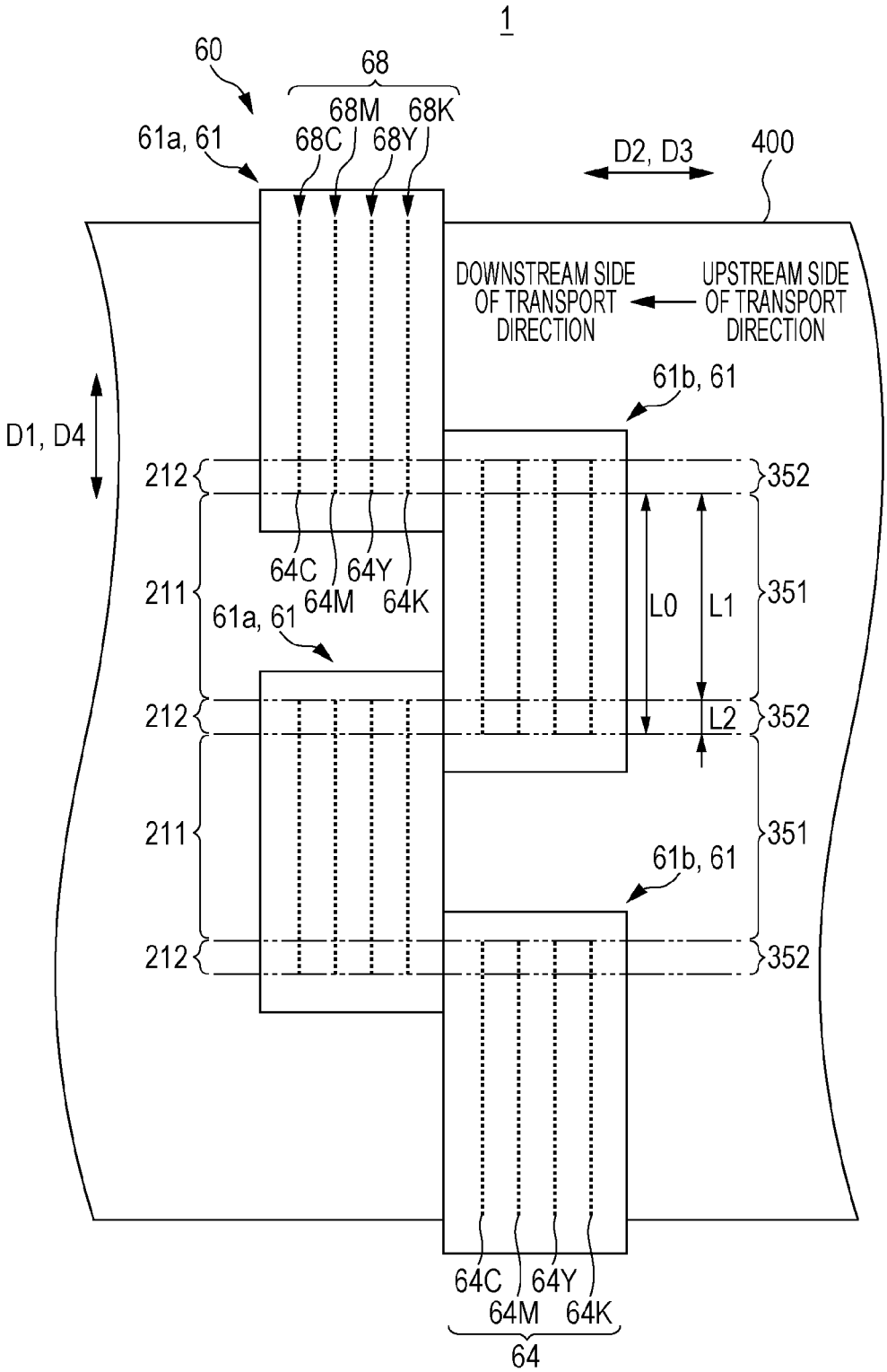
FIG. 16 is a diagram which schematically exemplifies main parts of the line printer as the recording apparatus.
Figure 17:
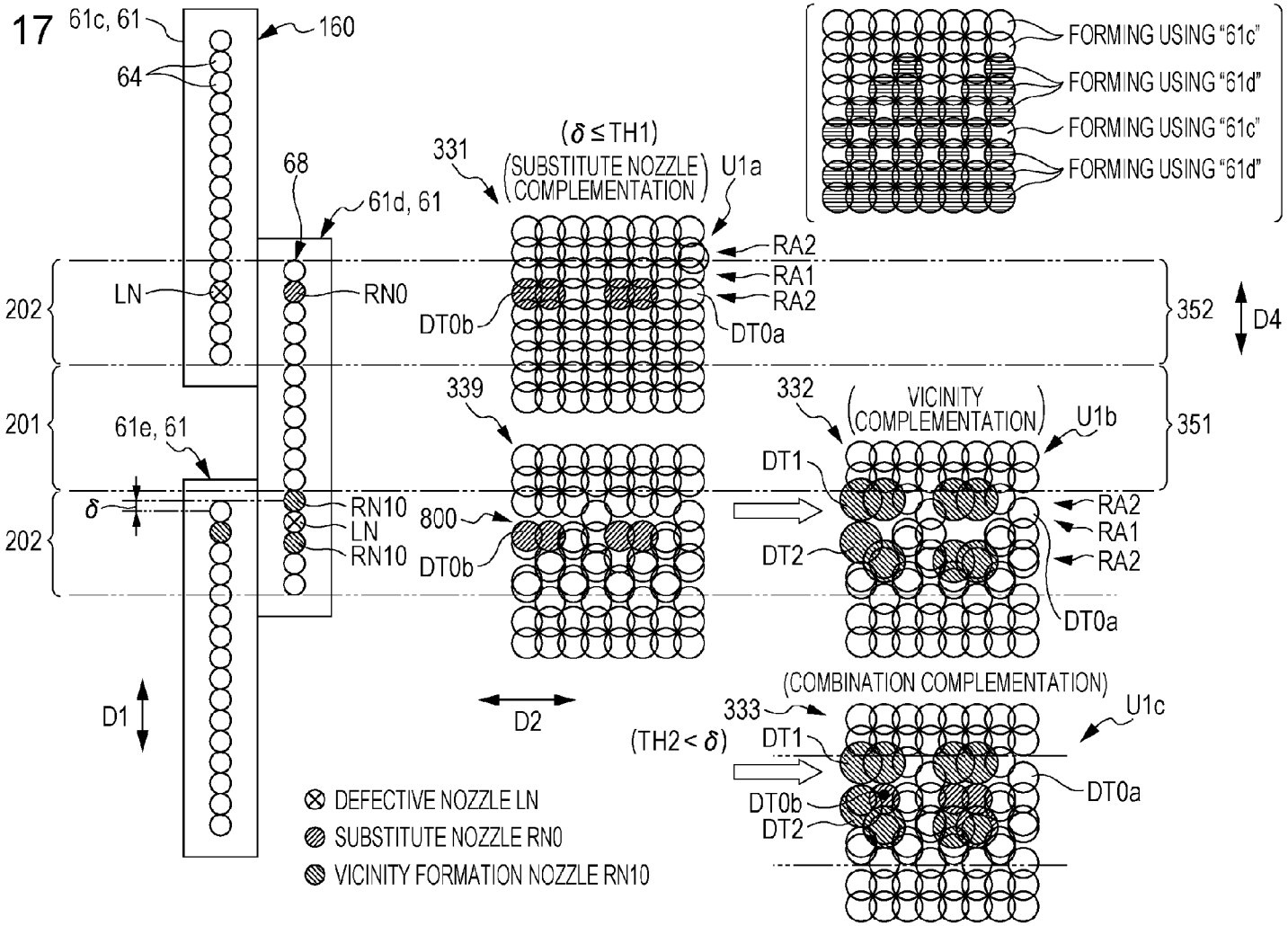
FIG. 17 is a diagram which schematically exemplifies a concept of switching a complementing process when a defective nozzle is present inside the overlapping portion.

FIGS. 13 and 17 schematically illustrate concepts of switching a complementing process when there is a defective nozzle LN in the overlapping portion 202 using a line printer in which nozzles 64 of a first head and a second head included in a head unit 160 are partially overlapped in the aligning direction D1 as an example. FIG. 14 schematically illustrates an example of a correlation between a nozzle 64 and a pixel PX. FIG. 15 schematically illustrates a configuration example of a line printer as a recording apparatus 1. FIG. 16 schematically exemplifies main parts of the line printer as the recording apparatus 1. In the specific example, a reference numeral D1 denotes an aligning direction of the nozzles 64, a reference numeral D3 denotes a transport direction of the matter for recording 400, a reference numeral D2 denotes a relative movement direction of the head 61 based on the matter for recording 400 which is transported, and a reference numeral D4 denotes a width direction of the matter for recording 400. When the sheet feeding mechanism 53 transports the matter for recording 400 from the upstream side in the transport direction to the downstream side in the transport direction, the head 61 relatively moves from the downstream side in the transport direction to the upstream side in the transport direction with respect to the matter for recording 400. In examples in FIG. 16, or the like, the aligning direction D1 and the width direction D4 match with each other; however, the aligning direction D1 and the width direction D4 may be deviated from each other by approximately 45 degrees, or the like. These directions D1, D4, and the relative movement direction D2 (transport direction D3) may be different directions from each other, and a case in which the directions cross each other diagonally without being orthogonal is also included in the present invention, not only the case of being orthogonal to each other, for example, crossing at an angle of approximately 45 degrees, or the like.

The head unit 160 illustrated in FIG. 16 includes a recording head 61 including a nozzle column 68C of C, a nozzle column 68M of M, a nozzle column 68Y of Y, and a nozzle column 68K of K. The head 61 may be provided in each color of CMYK. Each of nozzle columns 68C, 68M, 68Y, and 68K are aligned in the transport direction D3 of the matter for recording. In each of nozzle columns 68C, 68M, 68Y, and 68K, nozzles 64C, 64M, 64Y, and 64K are aligned in the aligning direction D1. In the head unit 160, a plurality of the heads 61 are arranged so that dots DT are formed on the matter for recording 400 using ink droplets 67 which are ejected from the nozzles 64C, 64M, 64Y, and 64K in the entire width direction D4 of the matter for recording 400. Here, the nozzle columns 68C, 68M, 68Y, and 68K are collectively referred to as a nozzle column 68, and the nozzles 64C, 64M, 64Y, and 64K are collectively referred to as a nozzle 64.

The head unit 160 includes a plurality of the nozzle columns 68 in which the plurality of nozzles 64 are aligned in a predetermined aligning direction D1. Here, the nozzle column 68 means any of nozzle columns of CMYK. In here, as illustrated in FIG. 14, a part of nozzles 64 of a first nozzle column 68*a* and a second nozzle column 68*b* which are includes in the plurality of nozzle columns 68 are overlapped in the aligning direction D1. The matter for recording 400 moves in the transport direction D3 with respect to the plurality of nozzle columns 68, and when ink droplets 67 are ejected from the nozzle 64, a dot DT of a raster facing the relative movement direction D2 is formed.

In FIG. 16, the length in the aligning direction D1 of the nozzle column 68 is set to L0, the length in an overlapping portion 212 in which positions of neighboring heads 61*a* and 61*b* in the aligning direction D1 in nozzles 64 are overlapped in the aligning direction D1 is set to L2, and the length of a single portion 211 in which positions of the neighboring heads 61*a* and 61*b* in the aligning direction D1 in nozzles 64 are not overlapped in the aligning direction D1 is set to L1. The length L3 in the nozzle column becomes L1+2×L2. In a printed image, an overlapping region 352 in which dots are formed using nozzles of both heads 61*a* and 61*b*, and a single region 351 in which dots are formed using one of the heads 61*a* and 61*b* are generated.

As illustrated in FIG. 14, when there is a defective nozzle LN in the overlapping portion 212, a substitute nozzle RN0 which can form a dot DT0 using another head (substitute head) on the first raster RA1 on which a dot is to be formed using a defective nozzle LN is present. A plurality of the substitute nozzles may be present, and also a plurality of the substitute heads may be present. When there is no error in a positional relationship between a first nozzle column 68*a* in a target head 61*a* in which a defective nozzle LN is present and a second nozzle column 68*b* in a neighboring substitute head 61*b* in the aligning direction D1, a complementing dot can be formed using a substitute nozzle RN0 which is included in the second nozzle column 68*b* in the overlapping portion 212.

In the specific example, the head 61*a* in which the defective nozzle LN is present in the overlapping portion 212 is referred to as a "target head", and another head 61*b* which can form a dot on the first raster RA1 which is to be recorded using the defective nozzle LN is referred to as a "substitute head". In the specific example, the substitute nozzle RN0 is a nozzle which is included in the substitute head 61*b* in the overlapping portion 212, and forms a dot on the first raster RA1, and primary vicinity formation nozzles RN1 and RN2 are nozzles which form dots on the second raster RA2 neighboring the first raster RA1 in the aligning direction D1, secondary vicinity formation nozzles RN3 and RN4 are nozzles which form dots on the third raster RA3 neighboring the second raster RA2 on a side opposite to the first raster RA1 from the second raster RA2, neighboring pixels PX1 and PX2 are neighboring pixels which are neighboring both sides of a dot omission pixel PXL in the width direction D4, and secondary neighboring pixels PX3 and PX4 are neighboring pixels which are neighboring the neighboring pixels PX1 and PX2 on a side opposite to the dot omission pixel PXL from the neighboring pixels PX1 and PX2. Also in the specific example, the nozzles RN1 and RN2 which form dots on the second raster RA2 are collectively referred to as a vicinity formation nozzle RN10.

The recording apparatus 1 illustrated in FIG. 15 includes a rearranging processing unit 145 instead of the rasterizing processing unit 45 illustrated in FIG. 3, and includes the head unit 160 instead of the carriage motor 51, the belt 52, and the carriage 60 which are illustrated in FIG. 3. The same elements as those in the recording apparatus 1 illustrated in FIG. 3 are given the same reference numerals, and detailed descriptions will be omitted.

The rearranging processing unit 145 illustrated in FIG. 15 performs a rearranging process in which halftone data is rearranged in order of forming a dot in a mechanism unit 50, and generates nozzle data by performing the rearranging process (for example, rotating process). The nozzle data may be binary data, or may be multivalue data of three gradations or more.

It is possible to determine a nozzle in which head is to be used in each pixel in the overlapping portion 212, for example, by obtaining a logical product between a mask pattern and halftone data which are provided in each head of the overlapping portion 212. The mask pattern can be set to data in which "1" is stored at a portion in which halftone data is to be remained, and "0" is stored at a portion in which halftone data is to be eliminated, for example.

The rearranging processing unit 145 illustrated in FIG. 15 includes a plurality of complementing units U1 which form a complementing dot for complementing a dot to be formed using the defective nozzle LN, and a selection unit U2 which selects any complementing unit U1 from among the plurality of complementing units U1. Dot complementation using the complementing unit U1 may be performed before performing a rearranging process, may be performed after the rearranging process, and may be performed simultaneously with the rearranging process. When the dot complementation is performed before the rearranging process, halftone data becomes the original data 300 before dot complementation, and halftone data after the dot complementation becomes recording data 310. When the dot complementation is performed after the rearranging process, nozzle data becomes the original data 300 before dot complementation, and nozzle data after the dot complementation becomes recording data 310. When the dot complementation is performed simultaneously with the rearranging process, halftone data becomes the original data 300 before the dot complementation, and nozzle data becomes the recording data 310. In addition, when performing the dot complementation, the recording data 310 may be generated by changing the mask pattern.

The plurality of complementing units U1 include a substitute nozzle complementing unit U1*a*, a vicinity complementing unit U1*b*, and a combination complementing unit U1*c*. The substitute nozzle complementing unit U1*a* forms a complementing dot on the first raster RA1 using the substitute nozzle RN0 without using the vicinity formation nozzle RN10. The vicinity complementing unit U1*b* forms a complementing dot on the second raster RA2 using the vicinity formation nozzle RN10 without using the substitute nozzle RN0. The combination complementing unit U1*c* forms a complementing dot on the first raster RA1 using the substitute nozzle RN0, and on the second raster RA2 using the vicinity formation nozzle RN10. The selection unit U2 selects any complementing unit from among the complementing units U1*a*, U1*b*, and U1*c* based on an amount δ of attachment error of the head 61 (error in positional relationship between first nozzle column 68*a* and second nozzle column 68*b* in aligning direction D1), and causes the complementing unit U1 to perform a complementing process of generating recording data 310 in which a dot is complemented based on the original data 300. The amount δ of attachment error in the specific example is different from the amount δ of sending error in specific examples of the first and second technologies, is set to a number 0 or more based on a state of no error, and in both a case in which an error toward one side in the aligning direction D1 increases and a case in which an error toward the other side in the aligning direction D1 increases, the error amount δ increases.

In the example illustrated in FIG. 13 in which the defective nozzle LN is present at an end portion of the overlapping portion 212, a printed image 331 in which the substitute nozzle complementing unit U1*a* is selected, when the error amount δ is small, for example, a threshold value TH1 or less, and a complementing dot DT0*b* is formed on the first raster RA1 using the substitute nozzle RN0 is illustrated. In this case, the head 61*c* is the target head, and the head 61*d* is the substitute head. When the error amount δ exceeds the threshold value TH1, it is possible to make the stripe 800 not attract attention in a printed image 332 when vicinity complementation is performed by selecting the vicinity complementing unit U1*b*, and large dots (complementing dots DT1 and DT2) are formed on the second raster RA2 using the vicinity formation nozzle RN10. In this case, the head 61*d* is the target head, and a head 61*e* is the substitute head. When the error amount δ exceeds a threshold value TH2, it is possible to make the stripe 800 not attract attention in a printed image 333 when both the vicinity complementation and the substitute nozzle complementation are performed by selecting the combination complementing unit U1*c*, large dots (complementing dots DT1 and DT2) are formed on the second raster RA2, and the complementing dot DT0*b* is formed on the first raster RA1.

Also in an example in FIG. 17 in which a defective nozzle LN is present inside the overlapping portion 202, the printed image 331 in which the substitute nozzle complementing unit U1*a* is selected when the error amount δ is small, for example, the threshold value TH1 or less, and the complementing dot DT0*b* is formed on the first raster RA1 using the substitute nozzle RN0 is illustrated. When the error amount δ exceeds the threshold value TH1, it is possible to make the stripe 800 not attract attention in a printed image 332 when vicinity complementation is performed by selecting the vicinity complementing unit U1*b*, and large dots (complementing dots DT1 and DT2) are formed on the second raster RA2 using the vicinity formation nozzle RN10. When the error amount δ exceeds the threshold value TH2, it is possible to make the stripe 800 not attract attention in printed image 333 by performing both the vicinity complementation and the substitute nozzle complementation by selecting the combination complementing unit U1*c*, and forming the large dot DT0*b*(complementing dot DT1 and DT2) on the second raster RA2.

In addition, when an error amount δ for each position is set between each of heads 61, it is possible to select any complementing unit U1 based on the error amount δ for each position. In this manner, it is possible to further appropriately complement a dot to be formed using the defective nozzle LN.

Figure 18:
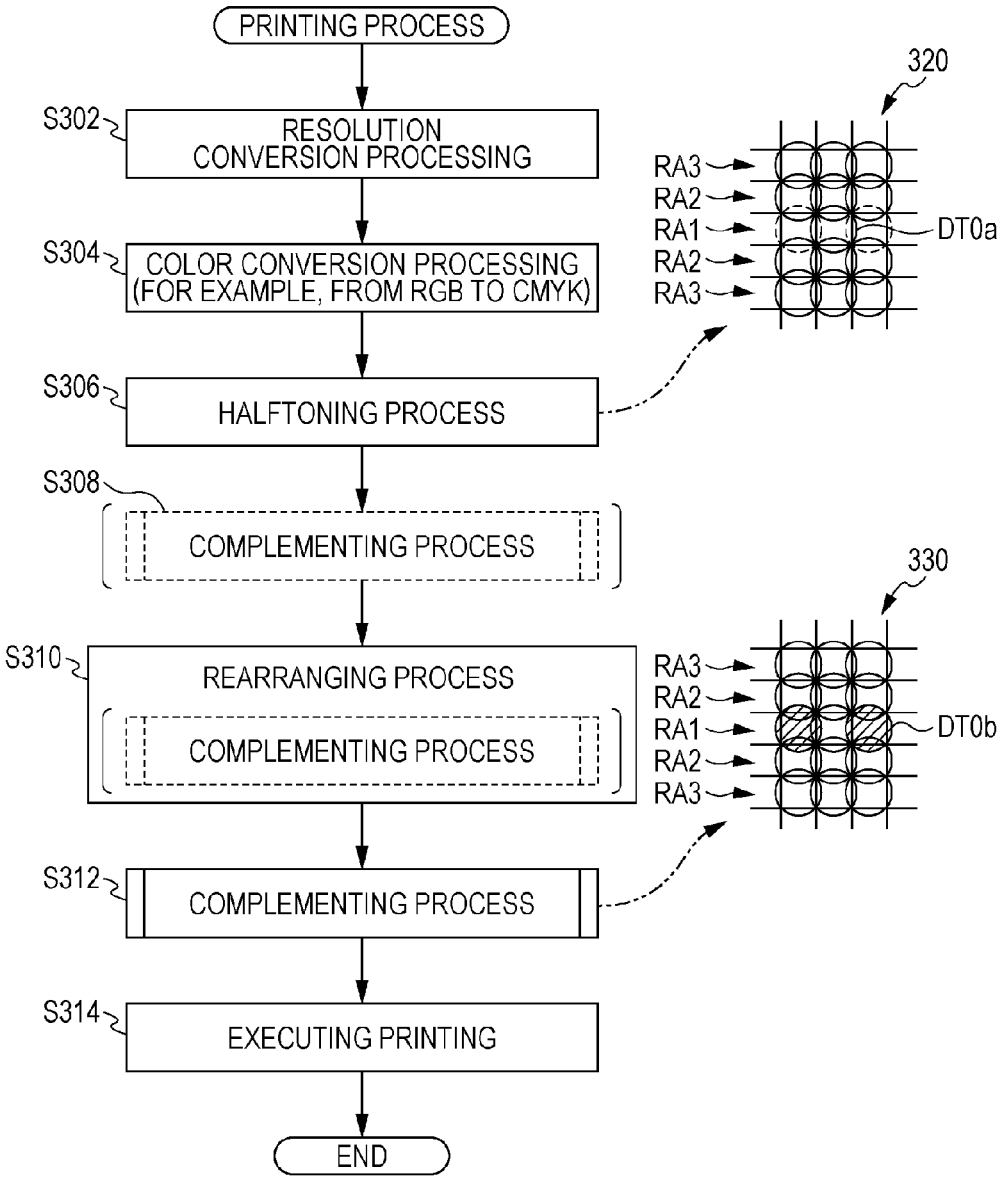
FIG. 18 is a flowchart which illustrates an example of a printing process.

FIG. 18 illustrates an example of printing process which is performed in the recording apparatus 1 using a flowchart. Processes in S302 to S308, and S312 to S314 are the same as those in S102 to S108, and S112 to S114 which are illustrated in FIG. 9.

When the complementing process is performed after the rearranging process, after the resolution conversion processing, the color conversion processing, and the halftoning processing (S302 to S306), the rearranging processing unit 145 performs predetermined rearranging process such as a rotating process with respect to halftone data, rearranges the data in order of forming a dot in the mechanism unit 50, and generates respective nozzle data of CMYK (S310). Thereafter, complementing process is performed by the complementing unit U1 and the selection unit U2, and nozzle data (recording data 310) in which a dot is complemented from nozzle data (original data 300) before dot complementation is generated (S312). The driving signal transmission unit 46 generates a driving signal SG corresponding to nozzle data, outputs the signal to the driving circuit 62 of the head 61, and performs printing by causing the driving element 63 to be driven according to nozzle data, and by causing ink droplets 67 to be ejected from the nozzle 64 of the head 61 (S314). In this manner, a multivalue printed image (for example, four value) in which a formation situation of dots are expressed on the matter for recording 400 is formed, and the printing process is completed.

For a complementing process in S312, it is possible to perform the same processes as those illustrated in FIGS. 10 to 12. When a complementing process in the third technology is described with reference to FIG. 10, first, the selection unit U2 branches processes by comparing an amount δ of attachment error of the head 61 to threshold values TH1 and TH2 (TH1<TH2) (S202). In the process, substitute nozzle complementation may be selected when the error amount δ is in a first allowable range (for example, δ≤TH1), combination complementation may be selected when the error amount δ is out of a second allowable range (for example, TH2<δ), and vicinity complementation may be selected when the error amount δ is out of the first allowable range and in the second allowable range (for example, TH1<δ≤TH2). In addition, "in the first allowable range" may be δ<TH1, "out of the second allowable range" may be TH2≤δ, and "out of the first allowable range and in the second allowable range" may be TH1≤δ<TH2. Here, the second allowable range corresponds to a "predetermined allowable range" in which whether or not the combination complementing unit U1*c* is selected is determined.

The substitute nozzle complementing unit U1*a* which is selected when the error amount δ is in the first allowable range performs substitute nozzle complementation in which a complementing dot is formed on the first raster RA1 using the substitute nozzle RN0 without using the vicinity formation nozzle RN10 (S204). When an attachment error of the head 61 is small, the complementing dot DT0*b* is formed on the first raster RA1 which is to be recorded using a defective nozzle LN, and in particular, a dot to be formed using the defective nozzle LN is preferably complemented.

The vicinity complementing unit U1*b* which is selected when the error amount δ is out of the first allowable range and in the second allowable range performs vicinity complementation in which a complementing dot is formed on the second raster RA2 using the vicinity formation nozzle RN10 without using the substitute nozzle RN0 (S206). When the attachment error of the head 61 is large to some extent, the stripe 800 attracts attention only by performing the substitute nozzle complementation; however, in particular, a dot to be formed using the defective nozzle LN is preferably complemented by forming complementing dots DT1 and DT2 on the second raster RA2 neighboring the first raster RA1.

The combination complementing unit U1*c* which is selected when the error amount δ is out of the second allowable range performs combination complementation in which a complementing dot is formed on the first raster RA1 using the substitute nozzle RN0, and on the second raster RA2 using the vicinity formation nozzle RN10 (S208). When the attachment error of the head 61 is larger, the stripe 800 attracts attention only by performing the vicinity complementation; however, in particular, a dot to be formed using the defective nozzle LN is preferably complemented by forming the complementing dot DT0*b* on the first raster RA1.

In addition, FIG. 11 illustrates another example of a complementing process which is performed in S312 in the third technology using a flowchart. FIG. 12 illustrates another example of a complementing process which is performed in S312 in the fourth technology using a flowchart. In both examples, in particular, a dot to be formed using the defective nozzle LN is preferably complemented.

In addition, in a printing process which is illustrated in FIG. 18, a complementing process may be performed before a rearranging process (S310) (S308), and may be simultaneously performed with the rearranging process (S310).

As described above, when it is possible to sufficiently suppress the stripe 800 due to an error by complementing a dot to be formed using the defective nozzle LN by performing the substitute nozzle complementation, the complementing dot DT0*b* is formed on the first raster RA1 using the substitute nozzle RN0 without forming the complementing dot using the vicinity formation nozzle RN10, by selecting the substitute nozzle complementing unit U1*a*. In this manner, it is possible to suppress excessive complementation. In addition, when it is possible to sufficiently suppress the stripe 800 due to an error by complementing the dot to be formed using the defective nozzle LN by performing a dot complementation using the vicinity complementing unit U1*b*, complementing dots DT1 and DT2 are formed on the second raster RA2 using the vicinity formation nozzle RN10 without forming the complementing dots using the substitute nozzle RN0, by selecting the vicinity complementing unit U1*b*. In this manner, it is possible to suppress excessive complementation. In addition, when complementation is insufficient by performing the vicinity complementation due to the error by selecting the combination complementing unit U1*c*, a complementing dot is formed on the first raster RA1 using the substitute nozzle RN0, and is formed on the second raster RA2 using the vicinity formation nozzle RN10. Accordingly, in the recording apparatus 1, it is possible to further appropriately complement the dot to be formed using the defective nozzle LN. In addition, since the substitute nozzle complementing unit U1*a* or the vicinity complementing unit U1*b* is selected when the amount δ of attachment error of the head 61 is small, and the combination complementing unit U1*c* is selected when the error amount δ is large, the dot to be formed using the defective nozzle LN is further appropriately complemented.

In addition, when there is an overlapping portion of nozzle between nozzle columns, it is possible to apply the technology. Accordingly, the technology can also be applied to a recording apparatus in which all of nozzles are overlapped between nozzle columns, not only to a recording apparatus in which nozzles between nozzle columns are partially overlapped.

In addition, a printer to which the third and fourth technologies can be applied is not limited to a line printer, and a multihead-type serial printer in which a plurality of heads (for example, the heads 61*a* and 61*b* employing the disposition illustrated in FIG. 16) in which part of nozzle columns are overlapped are mounted on a carriage is also included. In the serial printer, a matter for recording does not move, and a plurality of heads move when forming a dot by ejecting ink droplets. Accordingly, in a relative movement between the plurality of heads and the matter for recording, at least a case in which the plurality of heads do not move, and the matter for recording moves, and a case in which the matter for recording does not move, and the plurality of heads move are included.

(4) MODIFICATION EXAMPLE

Various modification examples are taken into consideration in the invention.

For example, in a recording apparatus to which the technology can be applied, a copy machine, a fax machine, and the like, are also included.

Ink is not limited to liquid for expressing a color, and a variety of types of liquid which provide some functions such as colorless liquid which shows a glossy feeling is included. Accordingly, in ink droplets, a variety of ink droplets such as colorless liquid droplets are includes.

In addition, even in a recording apparatus in which the defective nozzle detection portion U3 is not provided, it is possible to obtain a basic effect of the technology.

(5) CONCLUSION

As described above, according to the invention, it is possible to provide a technology, or the like, in which it is possible to improve an effect of complementing a dot to be formed using the defective nozzle LN using various aspects. As a matter of course, it is possible to obtain the above described basic operation and effect using a technology with only constituent elements according to a dependent claim without constituent elements according to an independent claim.

In addition, it is possible to execute a configuration in which each configuration disclosed in the above described embodiments and modification examples is mutually substituted, or a combination thereof is changed, a configuration in which each configuration disclosed in a well-known technology, and the above described embodiments and modification examples is mutually substituted, or a combination thereof is changed, or the like. The invention also includes these configurations.

What is claimed is:

1. A recording apparatus in which a plurality of nozzles aligned in a predetermined aligning direction and a matter for recording relatively move in a relative movement direction which is different from the aligning direction, and overlapping recording in which dots of a raster facing the relative movement direction are formed using a plurality of scanning operations is performed, and in which the plurality of nozzles include a defective nozzle which forms a defective dot, a substitute nozzle which forms a dot using another scanning operation on a first raster which is to be recorded using the defective nozzle, and a vicinity formation nozzle which forms a dot on a second raster neighboring the first raster, the recording apparatus comprising:

a plurality of complementing units which form a complementing dot for complementing a dot to be formed using the defective nozzle; and a selection unit which selects any complementing unit from among the plurality of complementing units, wherein the plurality of complementing units includes a substitute nozzle complementing unit which forms the complementing dot on the first raster using the substitute nozzle without using the vicinity formation nozzle, and a combination complementing unit which forms the complementing dot on the first raster using the substitute nozzle, and on the second raster using the vicinity formation nozzle.

2. The recording apparatus according to claim 1, wherein the plurality of complementing units includes a vicinity complementing unit which forms the complementing dot on the second raster using the vicinity formation nozzle without using the substitute nozzle.

3. The recording apparatus according to claim 1, wherein the selection unit selects the combination complementing unit when the error amount is out of a predetermined allowable range, and selects a complementing unit among the plurality of complementing units excluding the combination complementing unit, when the error amount is in the allowable range.

4. A recording apparatus in which a plurality of nozzles aligned in a predetermined aligning direction and a matter for recording relatively move in a relative movement direction which is different from the aligning direction, and which performs overlapping recording in which dots of a raster facing the relative movement direction are formed using a plurality of scanning operations, and in which the plurality of nozzles include a defective nozzle which forms a defective dot, a substitute nozzle which forms a dot on a first raster which is to be recorded using the defective nozzle using another scanning operation, and a vicinity formation nozzle which forms a dot on a second raster neighboring the first raster, the recording apparatus comprising:

a plurality of complementing units which form a complementing dot for complementing a dot to be formed using the defective nozzle; and a selection unit which selects any complementing unit from among the plurality of complementing units, wherein the plurality of complementing units include a vicinity complementing unit which forms the complementing dot on the second raster using the vicinity formation nozzle without using the substitute nozzle, and a combination complementing unit which forms the complementing dot on the second raster using the vicinity formation nozzle, and on the first raster using the substitute nozzle.

5. The recording apparatus according to claim 1, wherein the plurality of nozzles and the matter for recording relatively move in a transport direction which intersects the relative movement direction between scanning operations, and wherein the selection unit selects any complementing unit from among the plurality of complementing units based on an amount of error in a relative movement of the matter for recording in the transport direction.

6. A recording apparatus which includes a plurality of nozzle columns in which a plurality of nozzles are aligned in a predetermined aligning direction, in which nozzles of a first nozzle column and a second nozzle column which are included in the plurality of nozzle columns partially overlap in the aligning direction, the plurality of nozzle columns and a matter for recording relatively move in a relative movement direction which is different from the aligning direction, and dots of a raster facing the relative movement direction are formed, and in which the plurality of nozzles include a defective nozzle which is included in the first nozzle column, and forms a defective dot, a substitute nozzle which is included in the second nozzle column, and forms a dot on a first raster which is to be recorded using the defective nozzle, and a vicinity formation nozzle which forms a dot on a second raster neighboring the first raster, the recording apparatus comprising:

a plurality of complementing units which form a complementing dot for complementing a dot to be formed using the defective nozzle; and a selection unit which selects any complementing unit from among the plurality of complementing units based on an amount of error in positional relationship between the first nozzle column and the second nozzle column in the aligning direction, wherein the plurality of complementing units include a substitute nozzle complementing unit which forms the complementing dot on the first raster using the substitute nozzle without using the vicinity formation nozzle, and a combination complementing unit which forms the complementing dot on the first raster using the substitute nozzle, and on the second raster using the vicinity formation nozzle.

7. The recording apparatus according to claim 6, wherein the plurality of complementing units further include a vicinity complementing unit which forms the complementing dot on the second raster using the vicinity formation nozzle without using the substitute nozzle.

* * * * *